US009437361B2

(12) United States Patent
Honna

(10) Patent No.: US 9,437,361 B2
(45) Date of Patent: Sep. 6, 2016

(54) THREE-PHASE HIGH FREQUENCY TRANSFORMER

(75) Inventor: Tsunehiko Honna, Kanagawa (JP)

(73) Assignee: Seiden Mfg. Co., Ltd. (JP)

( * ) Notice: Subject to any disclaimer, the term of this patent is extended or adjusted under 35 U.S.C. 154(b) by 910 days.

(21) Appl. No.: 13/060,519

(22) PCT Filed: Aug. 18, 2009

(86) PCT No.: PCT/JP2009/064448
§ 371 (c)(1),
(2), (4) Date: Feb. 24, 2011

(87) PCT Pub. No.: WO2010/024153
PCT Pub. Date: Mar. 4, 2010

(65) Prior Publication Data

US 2011/0156851 A1 Jun. 30, 2011

(30) Foreign Application Priority Data

Aug. 25, 2008 (JP) ..... 2008-214993
Apr. 6, 2009 (JP) ..... 2009-092395

(51) Int. Cl.
*H01F 30/12* (2006.01)
*H01F 27/28* (2006.01)
*H01F 27/255* (2006.01)

(52) U.S. Cl.
CPC ..... *H01F 30/12* (2013.01); *H01F 27/255* (2013.01); *H01F 27/2847* (2013.01)

(58) Field of Classification Search
CPC ..... H01F 27/255; H01F 30/12
USPC ..... 336/5
See application file for complete search history.

(56) References Cited

U.S. PATENT DOCUMENTS 2,886,791 A * 5/1959 Barengoltz ..... H01F 30/12 336/100
3,593,243 A * 7/1971 Trump et al. ..... 336/60
(Continued)

FOREIGN PATENT DOCUMENTS

JP 61228608 A * 10/1986
JP 3-61313 U 6/1991
(Continued)

OTHER PUBLICATIONS

International Search Report relating to corresponding PCT/JP2009/064448.
(Continued)

*Primary Examiner* — Elvin G Enad
*Assistant Examiner* — Ronald Hinson
(74) *Attorney, Agent, or Firm* — Banner & Witcoff, Ltd.

(57) ABSTRACT

A three-phase high frequency transformer has: a ferrite core formed from three solid-cylindrical cores and a ceiling plate and a bottom plate; and three sets of coils having primary coils of a predetermined inner diameter that are formed by bending flat wires plural times in width directions of the flat wires, and secondary coils that are formed such that an inner diameter is the same as the inner diameter of the primary coils by bending flat wires, that have a width that is different than a width of the flat wires of the primary coils, in width directions of the flat wires, and the flat wires that structure the secondary coils are interposed within intervals of the flat wires that structure the primary coils, and the three sets of coils are structured such that inner peripheries of the primary coils and the secondary coils coincide, and are disposed such that the respective solid-cylindrical cores are inserted in respective inner portions, and the primary coils and the secondary coils are Δ-connected or Y-connected.

2 Claims, 45 Drawing Sheets

(56) References Cited

U.S. PATENT DOCUMENTS

| | | | | |
|---|---|---|---|---|
| 4,862,059 | A * | 8/1989 | Tominaga | G05F 1/13 307/66 |
| 4,901,048 | A * | 2/1990 | Williamson | 336/180 |
| 6,792,666 | B1 * | 9/2004 | Bolotinsky et al. | 29/602.1 |
| 6,831,544 | B2 * | 12/2004 | Patel et al. | 336/200 |
| 7,260,883 | B2 * | 8/2007 | Younger et al. | 29/602.1 |
| 2006/0087393 | A1 * | 4/2006 | Dahlgren et al. | 336/5 |

FOREIGN PATENT DOCUMENTS

| | | | |
|---|---|---|---|
| JP | 6-42327 | Y | 11/1994 |
| JP | 9232164 | A | 9/1997 |
| JP | 2000150269 | A | 5/2000 |
| JP | 2001143945 | A | 5/2001 |
| JP | 2004103624 | A | 4/2004 |
| JP | 2006147927 | A | 6/2006 |
| JP | 4287495 | B1 | 7/2007 |

OTHER PUBLICATIONS

English Translation of Office Action dated Jul. 14, 2009 relating to corresponding JP Application No. 2009-092395.
English Translation of Office Action dated Nov. 25, 2008 relating to corresponding JP Application No. 2008-214993.
English Abstract of JP 9232164.
English Abstract of JP 4287495.
English Abstract of JP 2000150269.
English Abstract of JP 2006147927.
English Abstract of JP 2004103624.
English Abstract of JP 2001143945.

* cited by examiner

THREE-PHASE HIGH FREQUENCY TRANSFORMER

RELATED APPLICATIONS

This application is a National Stage Application under 35 U.S.C. 371 of co-pending PCT application PCT/JP2009/064448 designating the United States and filed Aug. 18, 2009; which claims the benefit of JP patent application number 2009-092395 and filed Apr. 6, 2009 and JP patent application number 2008-214993 and filed Aug. 25, 2008 all of which are hereby incorporated by reference in their entireties.

TECHNICAL FIELD

The present invention relates to a three-phase high frequency transformer, and in particular, to a three-phase high frequency transformer that is suitable for use in an electric power converter and for use in an electric power source device.

BACKGROUND TECHNOLOGY

A triangularly-arranged three-legged core type three-phase transformer is proposed in which three iron cores, in which unit blocks, whose lateral cross-section is parallelogram-shaped and in which magnetic steel plates of a predetermined width are laminated, are set face-to-face with one another and are joined at 60° angles and the outer tangent line thereof is substantially circular, are arranged at the vertices of an equilateral triangle and are made to stand side-by-side with respect to one another, and upper and lower ends of these three iron cores are respectively joined by yokes (Japanese Patent Application Laid-Open No. 9-232164).

DISCLOSURE OF THE INVENTION

Problems to be Solved by the Invention

However, in a high frequency transformer that is used in an electric power converter or an electric power source device, in order to prevent magnetic flux leakage, alternately winding primary coils and secondary coils is generally carried out, such as winding the secondary coils so as to be enveloped by the primary coils, or so-called sandwich winding that, after winding the primary coil, winding the secondary coil, and further winding a primary coil thereon.

However, when adopting the above-described structure, the coupling degree is low and the leakage inductance is high. Therefore, there is the problem that the voltage ratio of the secondary output voltage is not in accordance with the turns ratio of the primary coils and the secondary coils, and the secondary output voltage drops when load current flows.

Further, in the high frequency transformer of the above-described structure, the primary coils and the secondary coils are wound in a superposed manner, and in addition, insulating materials are inserted between the primary coils and the secondary coils. Therefore, there is also the problem that heat is confined, and the current density at the primary coils and the secondary coils decreases.

The present invention was made in order to overcome the above-described problems, and an object thereof is to provide a high frequency transformer in which, because the voltage ratio of the secondary output voltage is in accordance with the turns ratio of the primary coils and the secondary coils, a drop in the secondary output voltage when load current flows is prevented, and further, heat being confined between the primary coils and the secondary coils can be prevented, and that is suitable for use in an electric power converter and an electric power source device.

Means for Solving the Problems

The invention of claim 1 relates to a three-phase high frequency transformer having: three solid-cylindrical cores that are formed of ferrite and that are disposed at uniform intervals on a circumference; a ceiling plate that is formed of ferrite and that connects one ends of the solid-cylindrical cores; a bottom plate that is formed of ferrite and that connects other ends of the solid-cylindrical cores; and three sets of coils having primary coils of a predetermined inner diameter that are formed by bending flat wires a plurality of times in width directions of the flat wires, and secondary coils that are formed such that an inner diameter is the same as the inner diameter of the primary coils by bending flat wires, that have a width that is different than a width of the flat wires, in width directions of the flat wires, and within intervals of the flat wires that structure ones of the primary coils and the secondary coils the flat wires that structure others of the primary coils and the secondary coils are interposed, and the three sets of coils are structured such that inner peripheries of the primary coils and inner peripheries of the secondary coils coincide, and are disposed such that the respective solid-cylindrical cores are inserted in respective inner portions, wherein a ceiling plate-side one end of any primary coil of the coils and a bottom plate-side other end of another one primary coil are connected, and a ceiling plate-side one end of the other one primary coil and a bottom plate-side other end of yet another one primary coil are connected, and a ceiling plate-side one end of the yet another one primary coil and a bottom plate-side other end of the any primary coil are connected, and a ceiling plate-side one end of any secondary coil of the coils and a bottom plate-side other end of another one secondary coil are connected, and a ceiling plate-side one end of the other one secondary coil and a bottom plate-side other end of yet another one secondary coil are connected, and a ceiling plate-side one end of the yet another one secondary coil and a bottom plate-side other end of the any secondary coil are connected.

The invention of claim 2 relates to a three-phase high frequency transformer having: three solid-cylindrical cores that are formed of ferrite and that are disposed at uniform intervals on a circumference; a ceiling plate that is formed of ferrite and that connects one ends of the solid-cylindrical cores; a bottom plate that is formed of ferrite and that connects other ends of the solid-cylindrical cores; and three sets of coils having primary coils of a predetermined inner diameter that are formed by bending flat wires a plurality of times in width directions of the flat wires, and secondary coils that are formed such that an inner diameter is the same as the inner diameter of the primary coils by bending flat wires, that have a width that is different than a width of the flat wires, in width directions of the flat wires, and within intervals of the flat wires that structure ones of the primary coils and the secondary coils the flat wires that structure others of the primary coils and the secondary coils are interposed, and the three sets of coils are structured such that inner peripheries of the primary coils and inner peripheries of the secondary coils coincide, and are disposed such that the respective solid-cylindrical cores are inserted in respective inner portions, wherein one ends at ceiling plate-sides or bottom plate-sides of the primary coils among the coils are connected to one another, and one ends at ceiling plate-sides or bottom plate-sides of the secondary coils are connected to one another.

The invention recited in claim 3 relates to a three-phase high frequency transformer having: three solid-cylindrical cores that are formed of ferrite and that are disposed at uniform intervals on a circumference; a ceiling plate that is formed of ferrite and that connects one ends of the solid-cylindrical cores; a bottom plate that is formed of ferrite and that connects other ends of the solid-cylindrical cores; and three sets of coils having primary coils of a predetermined inner diameter that are formed by bending flat wires a plurality of times in width directions of the flat wires, and secondary coils that are formed such that an inner diameter is the same as the inner diameter of the primary coils by bending flat wires, that have a width that is different than a width of the flat wires, in width directions of the flat wires, and within intervals of the flat wires that structure ones of the primary coils and the secondary coils the flat wires that structure others of the primary coils and the secondary coils are interposed, and the three sets of coils are structured such that inner peripheries of the primary coils and inner peripheries of the secondary coils coincide, and are disposed such that the respective solid-cylindrical cores are inserted in respective inner portions, wherein a ceiling plate-side one end of any primary coil of the coils and a bottom plate-side other end of another one primary coil are connected, and a ceiling plate-side one end of the other one primary coil and a bottom plate-side other end of yet another one primary coil are connected, and a ceiling plate-side one end of the yet another one primary coil and a bottom plate-side other end of the any primary coil are connected, and one ends at ceiling plate-sides or bottom plate-sides of the secondary coils at the coils are connected to one another.

The invention of claim 4 relates to a three-phase high frequency transformer having: three solid-cylindrical cores that are formed of ferrite and that are disposed at uniform intervals on a circumference; a ceiling plate that is formed of ferrite and that connects one ends of the solid-cylindrical cores; a bottom plate that is formed of ferrite and that connects other ends of the solid-cylindrical cores; and three sets of coils having primary coils of a predetermined inner diameter that are formed by bending flat wires a plurality of times in width directions of the flat wires, and secondary coils that are formed such that an inner diameter is the same as the inner diameter of the primary coils by bending flat wires, that have a width that is different than a width of the flat wires, in width directions of the flat wires, and within intervals of the flat wires that structure ones of the primary coils and the secondary coils the flat wires that structure others of the primary coils and the secondary coils are interposed, and the three sets of coils are structured such that inner peripheries of the primary coils and inner peripheries of the secondary coils coincide, and are disposed such that the respective solid-cylindrical cores are inserted in respective inner portions, wherein one ends at ceiling plate-sides or bottom plate-sides of the primary coils at the coils are connected to one another, and a ceiling plate-side one end of any secondary coil of the coils and a bottom plate-side other end of another one secondary coil are connected, and a ceiling plate-side one end of the other one secondary coil and a bottom plate-side other end of yet another one secondary coil are connected, and a ceiling plate-side one end of the yet another one secondary coil and a bottom plate-side other end of the any secondary coil are connected.

Effects of the Invention

In the three-phase high frequency transformer recited in claim 1, because both the primary coils and the secondary coils are Δ-connected, the respective interphase currents are $1/\sqrt{3}$ with respect to the voltage between the primary lines and the voltage between the secondary lines, and the windings of the primary coils and the secondary coils that are respectively wound around the three solid-cylindrical cores can be made narrow, and therefore, the three-phase high frequency transformer is suitable for large current use.

In the three-phase high frequency transformer recited in claim 2, because both the primary coils and the secondary coils are Y-connected, the respective interphase voltages are $1/\sqrt{3}$ with respect to the voltage between the primary lines and the voltage between the secondary lines, and the numbers of turns of the primary coils and the secondary coils that are respectively wound around the three solid-cylindrical cores also are $1/\sqrt{3}$, and therefore, the three-phase high frequency transformer can be constituted compactly and large electric power can be handled.

In the three-phase high frequency transformer recited in claim 3, because the primary coils are Δ-connected and the secondary coils are Y-connected, the three-phase high frequency transformer is suitable as a transformer for step-up. Further, there is also the advantage that, when high frequency waves are included in the input, the high frequency waves circulate through the primary coils that are Δ-connected, and therefore, the high frequency waves do not mix with the output waves.

In the three-phase high frequency transformer recited in claim 4, because the primary coils are Y-connected and the secondary coils are Δ-connected, the output of the secondary coils is suitable as a transformer for low voltage and large current. Further, in the same way as the three-phase high frequency transformer recited in claim 3, there is also the advantage that, when high frequency waves are included in the input, the high frequency waves circulate through the secondary coils that are Δ-connected, and therefore, the high frequency waves do not mix with the output waves.

FORMS FOR EMBODYING THE INVENTION

1. Embodiment 1

Figure 1A:
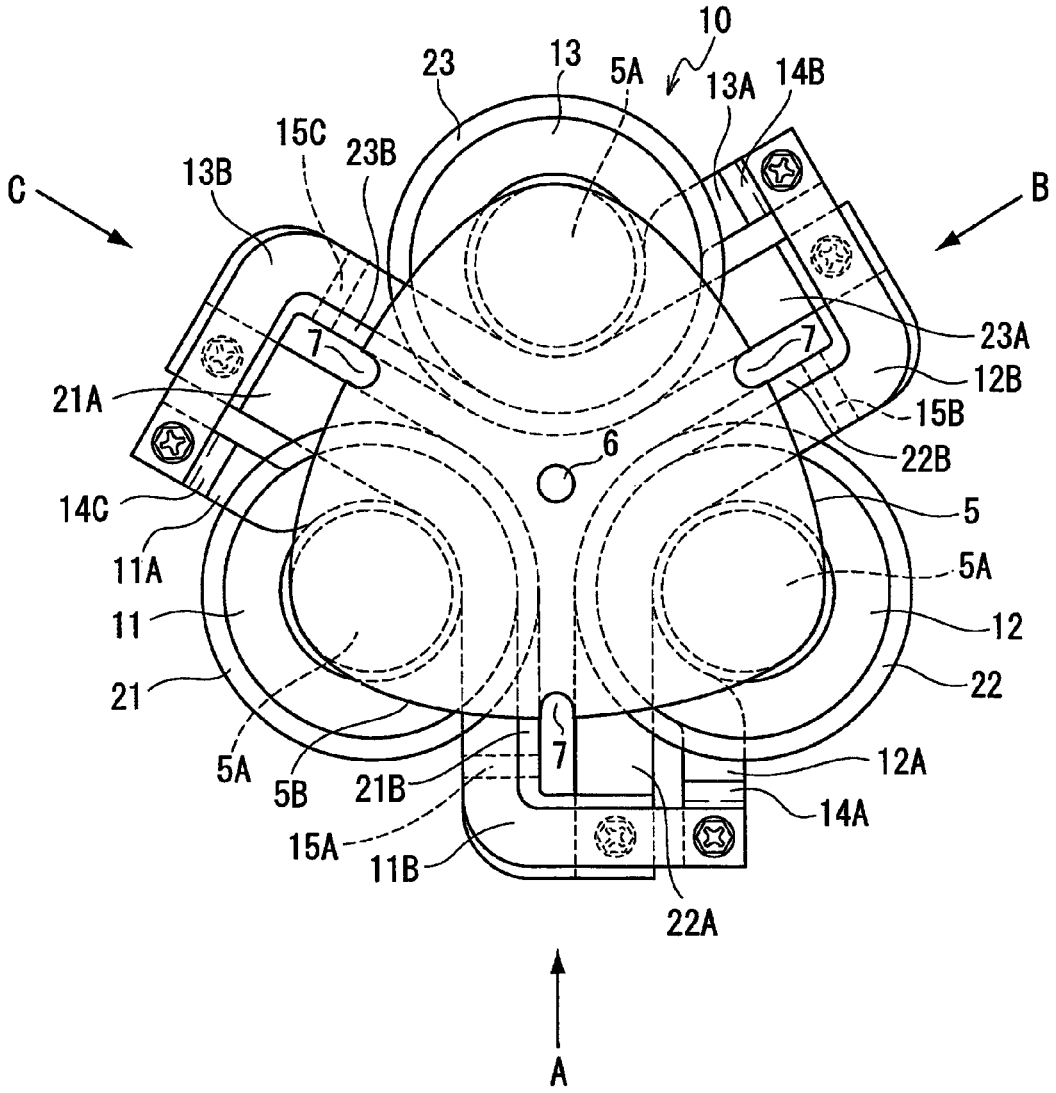
FIG. 1A is a plan view showing the structure of a three-phase high frequency transformer relating to embodiment 1.

Of the three-phase high frequency transformers of the present invention, an example in which both the primary coils and the secondary coils are Δ-connected is described hereinafter.

As shown in FIG. 1A to FIG. 1D, in a three-phase high frequency transformer 10 relating to embodiment 1, primary coils 11, 12, 13 and secondary coils 21, 22, 23 are wound at a three-legged ferrite core 5 for three phases.

The three-legged ferrite core 5 is comprehended as the ferrite cores of the high frequency transformer of the present invention, and, as shown in FIG. 1A to FIG. 1D, has three columnar cores 5A that are formed from ferrite and are disposed on a circumference at intervals of 120°, a ceiling plate 5B that is plate-shaped and is formed of ferrite and connects the upper ends of the three columnar cores 5A, and a bottom plate 5C that is formed of ferrite and connects the lower ends of the three columnar cores 5A.

The ceiling plate 5B and the bottom plate 5C have planar configurations that are shaped as equilateral triangles in which the vertices are rounded and each side swells in an arc shape toward the outer side. Further, a bolt insert-through hole 6 for the inserting-through of a fixing bolt (not shown) is provided in the central portion, and a bolt insert-through groove 7 similarly for the inserting-through of a fixing bolt is provided at the central portion of each side.

At the three-legged ferrite core 5, the columnar cores 5A can be divided upward and downward in two along a plane that is orthogonal to the axes thereof, and the upper halves can be made integral with the ceiling plate 5B, and the lower halves can be made integral with the bottom plate 5C. Further, instead of dividing the columnar cores 5A in two upward and downward, the columnar cores 5A and one of the ceiling plate 5B and the bottom plate 5C may be formed integrally, and the other of the ceiling plate 5B and the bottom plate 5C may be formed so as to be able to be separated from the columnar cores 5A.

The primary coil 11 and the secondary coil 21 are wound around one of the three columnar cores 5A, the primary coil 12 and the secondary coil 22 are wound around another one, and the primary coil 13 and the secondary coil 23 are wound around yet another one.

In other words, the primary coils 11, 12, 13 and the secondary coils 21, 22, 23 that structure the respective coils are coils that are formed by bending flat wires along the width directions thereof into annular shapes whose inner diameters are the same. Flat wires of different widths are used, and the flat wires that structure the secondary coils 21, 22, 23 are positioned within the intervals of the flat wires that structure the primary coils 11, 12, 13, and are disposed such that the inner peripheries thereof coincide.

Figure 1B:
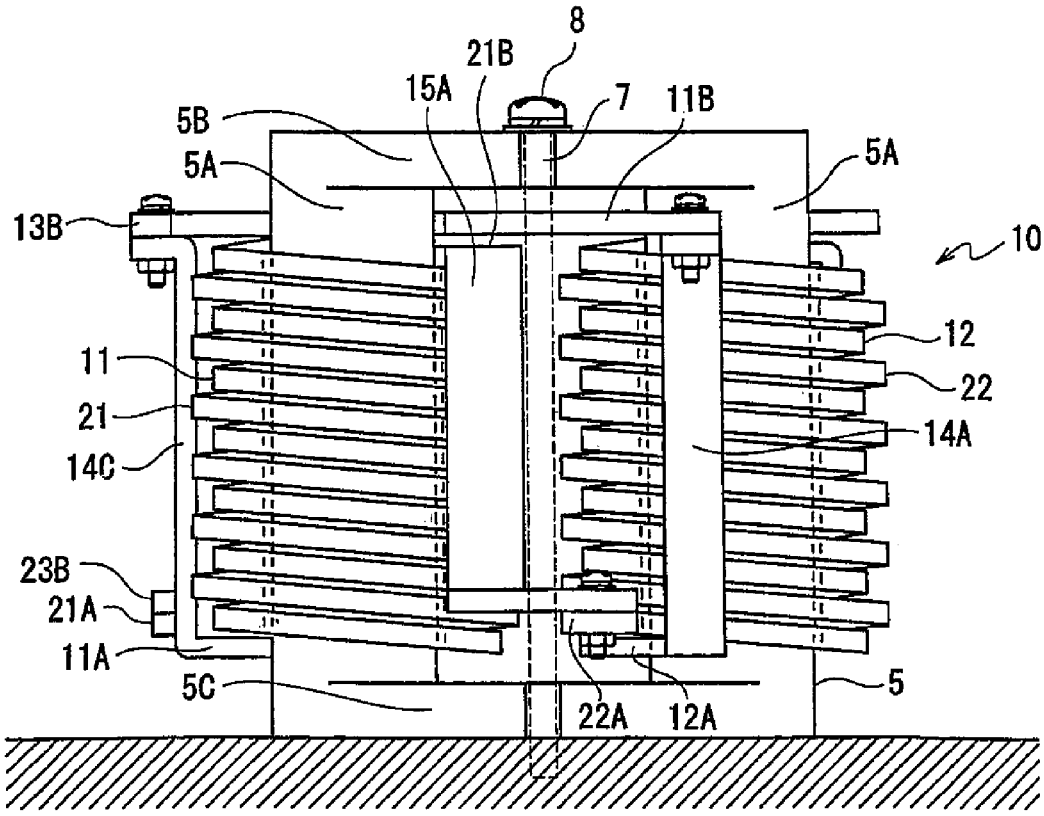
FIG. 1B is a side view showing the structure when viewing the three-phase high frequency transformer relating to embodiment 1 from the direction of arrow A in FIG. 1A.
Figure 1C:
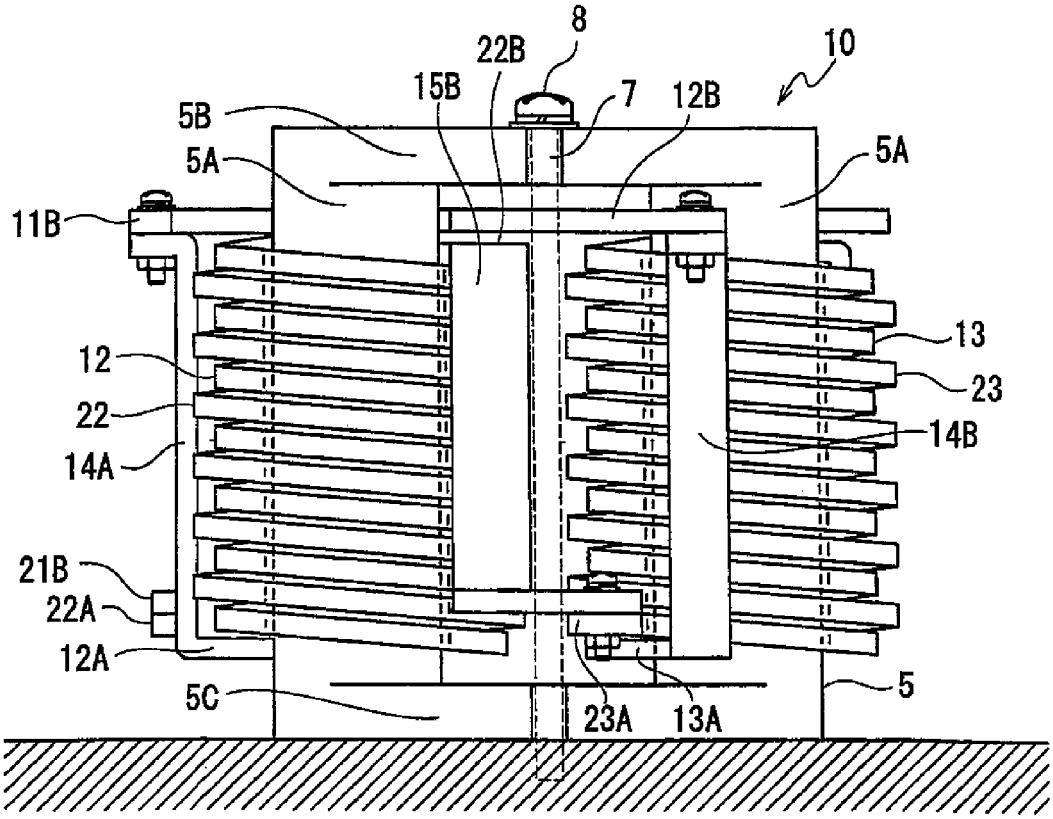
FIG. 1C is a side view showing the structure when viewing the three-phase high frequency transformer relating to embodiment 1 from the direction of arrow B in FIG. 1A.
Figure 1D:
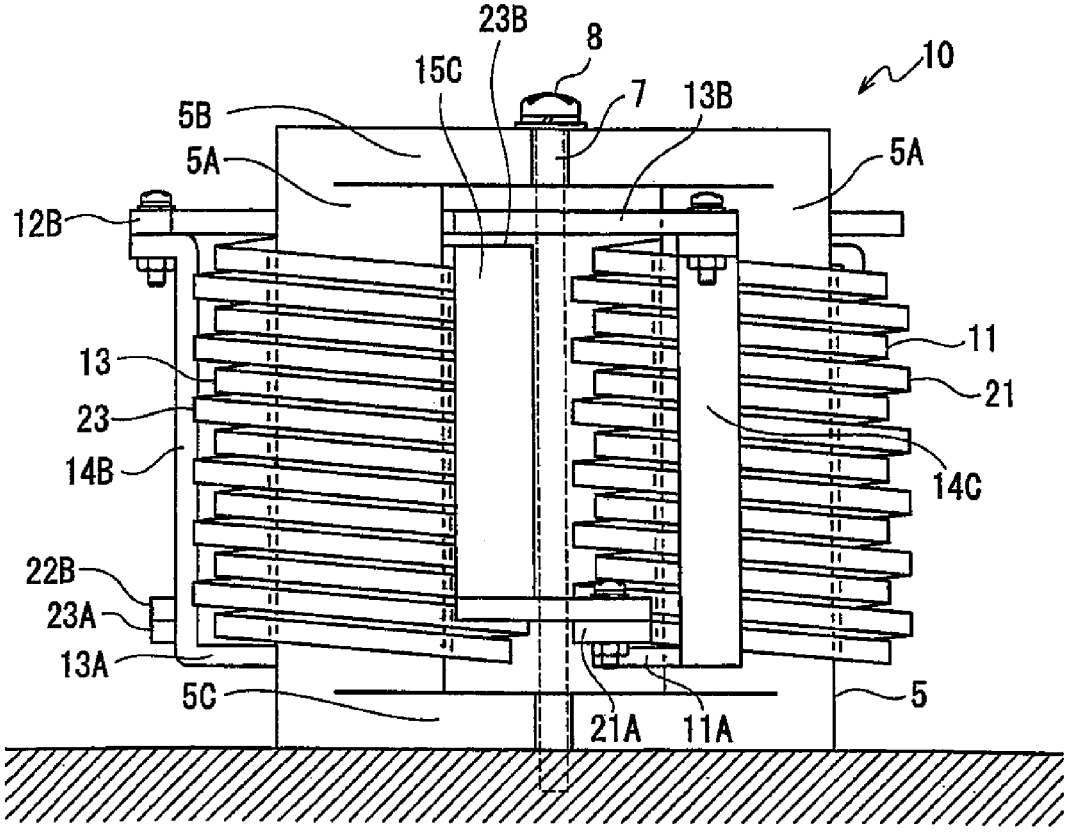
FIG. 1D is a side view showing the structure when viewing the three-phase high frequency transformer relating to embodiment 1 from the direction of arrow C in FIG. 1A.

Next, the connection of the primary coils together and the secondary coils together in the above-described three groups of coils is described by using FIG. 1A to FIG. 1D. FIG. 1A is a plan view when viewing the three-phase high frequency transformer 10 from above, FIG. 1B is a side view when viewing the three-phase high frequency transformer 10 from the direction of arrow A in FIG. 1A, FIG. 1C is a side view when viewing from the direction of arrow B in FIG. 1A, and FIG. 1D is a side view when viewing from the direction of arrow C in FIG. 1A.

As shown in FIG. 1A to FIG. 1D, at the three-phase high frequency transformer 10, both the primary coils 11, 12, 13 and the secondary coils 21, 22, 23 are wound around from the lower ends of the columnar cores 5A toward the upper ends. The winding start portion and the winding end portion of the primary coil 11 are respectively made to be lead lines 11A, 11B. Similarly, the winding start portion and the winding end portion of the primary coil 12 are respectively made to be lead lines 12A, 12B, and the winding start portion and the winding end portion of the primary coil 13 are respectively made to be lead lines 13A, 13B. Similarly, the winding start portion and the winding end portion of the secondary coil 21 are respectively made to be lead lines 21A, 21B, and the winding start portion and the winding end portion of the secondary coil 22 are respectively made to be lead lines 22A, 22B, and the winding start portion and the winding end portion of the secondary coil 23 are respectively made to be lead lines 23A, 23B.

With regard to the primary coils 11, 12, 13, as shown in FIG. 1A and FIG. 1B, the lead line 11B of the winding end portion of the primary coil 11 is connected by a bolt to the upper end of a connection line 14A in the vertical direction, and the lower end of the connection line 14A is bent in the horizontal direction and is made to be the lead line 12A of the winding start portion of the primary coil 12. Similarly, as shown in FIG. 1A and FIG. 1C, the lead line 12B of the winding end portion of the primary coil 12 is fixed by a bolt to the upper end of a connection line 14B in the vertical direction, and the lower end of the connection line 14B is bent in the horizontal direction and is made to be the lead line 13A of the winding start portion of the primary coil 13. Further, as shown in FIG. 1A and FIG. 1D, the lead line 13B of the winding end portion of the primary coil 13 is fixed by a bolt to the upper end of a connection line 14C in the vertical direction, and the lower end of the connection line 14C is bent in the horizontal direction and is made to be the lead line 11A of the winding start portion of the primary coil 11.

On the other hand, with regard to the secondary coils 21, 22, 23, as shown in FIG. 1A and FIG. 1B, the lead line 21B of the winding end portion of the secondary coil 21 is bent downward and made to be a connection line 15A, and the lower end of the connection line 15A is bent in the horizontal direction and fixed by a bolt to the lead line 22A of the winding start of the secondary coil 22. Similarly, as shown in FIG. 1A and FIG. 1C, the lead line 22B of the winding end portion of the secondary coil 22 is bent downward and made to be a connection line 15B, and the lower end of the connection line 15B is bent in the horizontal direction and fixed by a bolt to the lead line 23A of the winding start of the secondary coil 23. Moreover, as shown in FIG. 1A and FIG. 1D, the lead line 23B of the winding end portion of the secondary coil 23 is bent downward and made to be a connection line 15C, and the lower end of the connection line 15C is bent in the horizontal direction and fixed by a bolt to the lead line 21A of the winding start of the secondary coil 21.

The U-phase, V-phase, W-phase at the input side are respectively connected to the connection lines 14A, 14B, 14C, and the U-phase, V-phase, W-phase at the output side are respectively connected to the connection lines 15A, 15B, 15C. The connection of the U-phase, V-phase, W-phase to the connection lines 14A, 14B, 14C and the connection lines 15A, 15B, 15C can be carried out at, for example, portions of bolts.

Accordingly, the primary coils 11, 12, 13 and the secondary coils 21, 22, 23 are respectively Δ-connected.

Operation of the three-phase high frequency transformer 10 is described hereinafter. At the three-phase high frequency transformer 10, when three-phase high frequency current of a predetermined voltage, current and frequency is applied to the connection lines 14A, 14B, 14C, due to electromagnetic induction, a three-phase high frequency current, of which voltages and currents of U-phase, V-phase, W-phase are the voltages and currents corresponding to the turns ratios of the primary coil 11 and the secondary coil 21, the primary coil 12 and the secondary coil 22, and the primary coil 13 and the secondary coil 23, is output to the connection lines 15A, 15B, 15C.

At the three-phase high frequency transformer 10, the upper half portions of the columnar cores 5A and the ceiling plate 5B, and the lower half portions of the columnar cores 5A and the bottom plate 5C are formed integrally, and respectively structure the upper half portion and the lower half portion of the three-legged ferrite core 5. Further, because the upper half portion and the lower half portion of the three-legged ferrite core 5 are strongly fastened by fixing bolts 8 that are inserted-through the bolt insert-through hole 6 and the bolt insert-through grooves 7, no air gaps are formed between the columnar cores 5A and the ceiling plate 5B and the bottom plate 5C, and between the upper half portions and the lower half portions of the columnar cores 5A, and an increase in iron loss due to the existence of air gaps can be effectively suppressed.

Further, because the inner diameters of the primary coils 11, 12, 13 and the secondary coils 21, 22, 23 are equal, and further, the inner peripheries are disposed so as to coincide, the gaps between the primary coils 11, 12, 13 and the secondary coils 21, 22, 23, and the columnar cores 5A, are narrow, and therefore, even when used at high frequencies, a high conversion efficiency can be achieved.

Moreover, because both the primary coils 11, 12, 13 and the secondary coils 21, 22, 23 are Δ-connected, the current that flows to the primary coils 11, 12, 13 and the secondary coils 21, 22, 23 is $1/\sqrt{3}$ of the line current, and therefore, the winding conductors of the primary coils 11, 12, 13 and the secondary coils 21, 22, 23 can be made to be thin. Accordingly, they are suited to circuits requiring large current. Further, because both the primary coils 11, 12, 13 and the secondary coils 21, 22, 23 are Δ-connected and structure Δ circuits, high frequency current can be absorbed at the Δ circuits, and there is little distortion of the magnetic flux or the induced electromotive force.

2. Embodiment 2

Of the three-phase high frequency transformers of the present invention, an example in which both the primary coils and the secondary coils are Y-connected is described hereinafter.

Figure 2A:
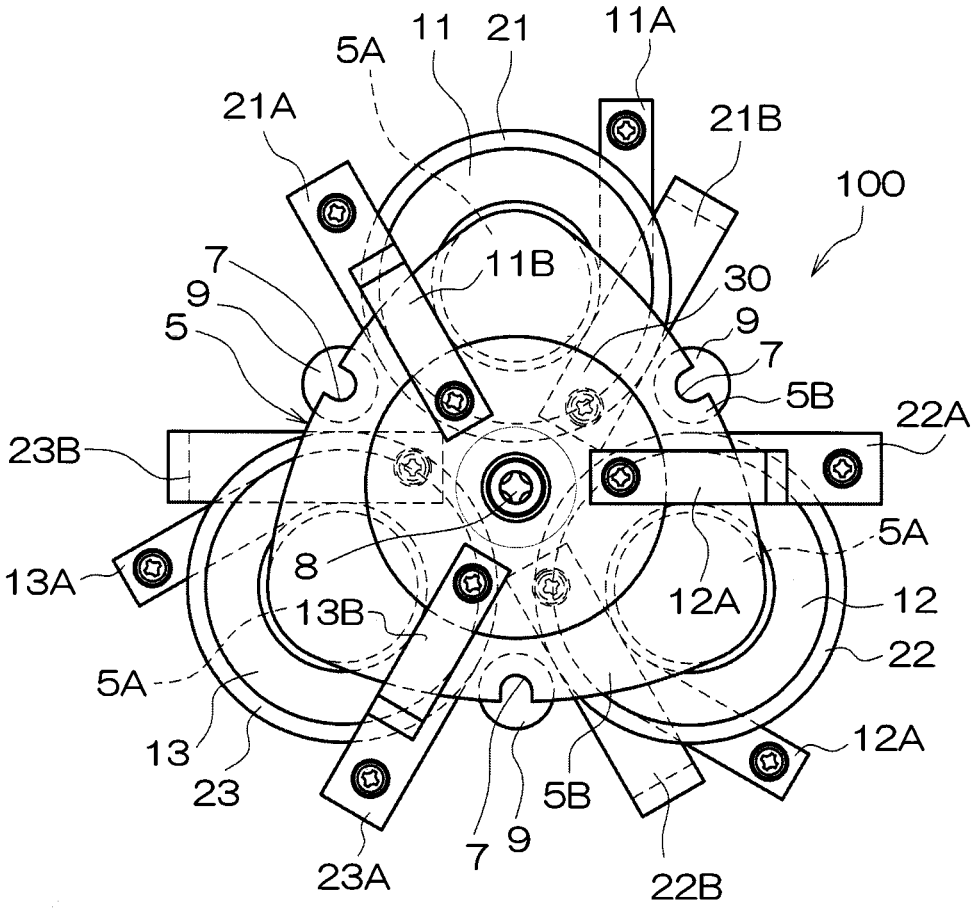
FIG. 2A is a plan view showing the structure of a three-phase high frequency transformer relating to embodiment 2.
Figure 2B:
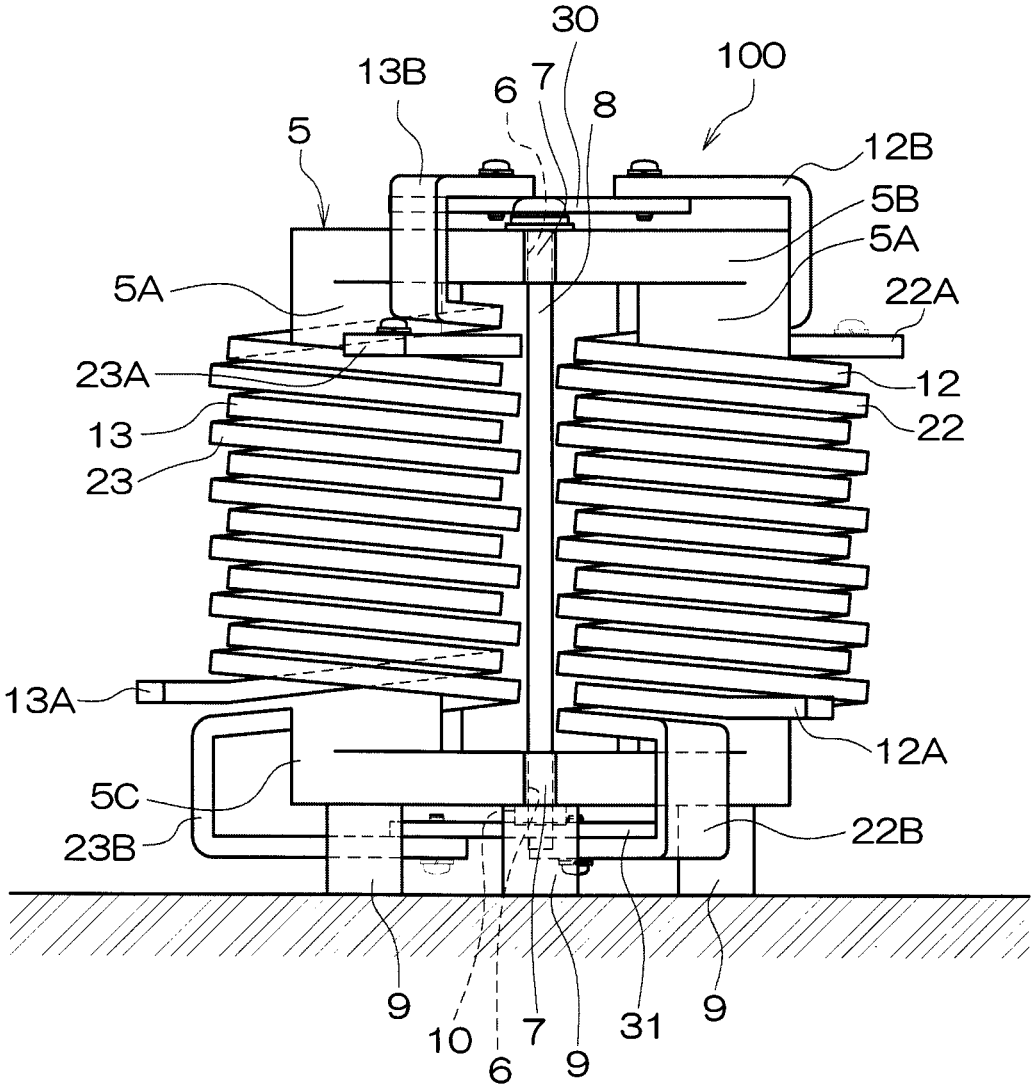
FIG. 2B is a side view showing the structure of the three-phase high frequency transformer relating to embodiment 2.
Figure 2C:
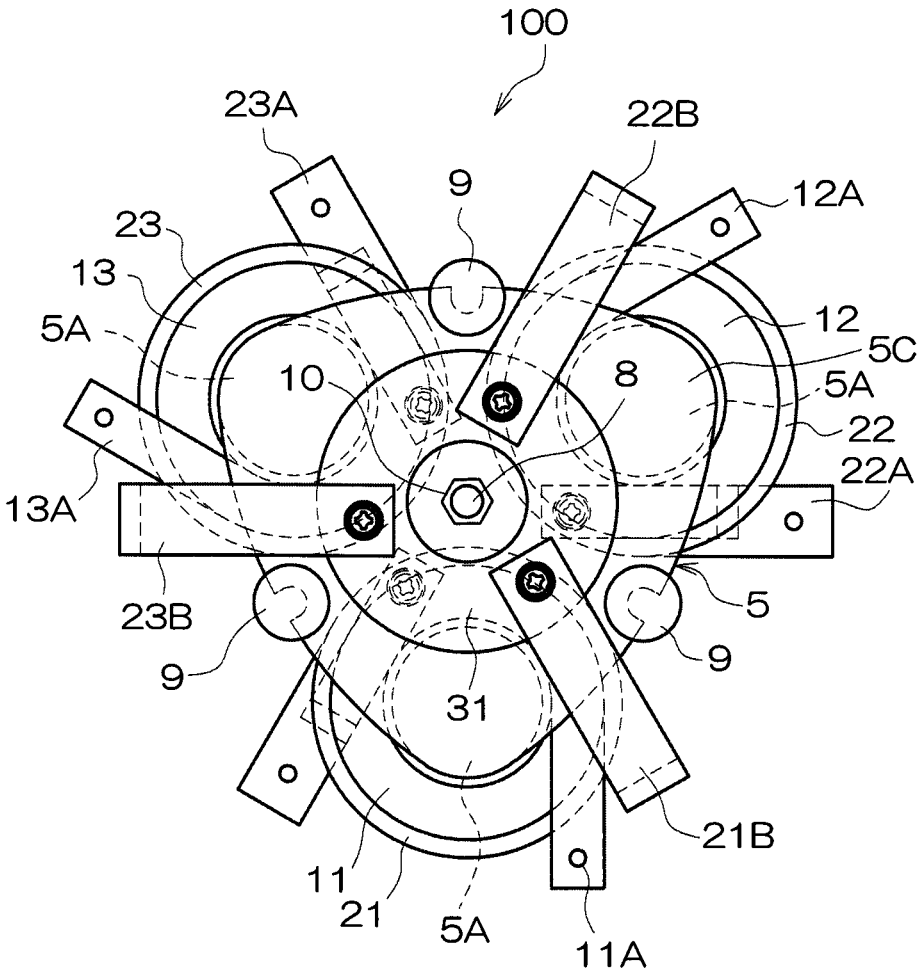
FIG. 2C is a bottom view showing the structure of the three-phase high frequency transformer relating to embodiment 2.

As shown in FIG. 2A to FIG. 2C, in a three-phase high frequency transformer 100 relating to embodiment 2, the primary coils 11, 12, 13 and the secondary coils 21, 22, 23 are wound at the three-legged ferrite core 5.

As shown in FIG. 2A to FIG. 2C, the three-legged ferrite core 5 has the three columnar cores 5A that are formed from ferrite and are disposed on a circumference at intervals of 120°, the ceiling plate 5B that is plate-shaped and formed of ferrite and connects the upper ends of the three columnar cores 5A, and the bottom plate 5C that is formed of ferrite and connects the lower ends of the three columnar cores 5A.

At the three-legged ferrite core 5, the columnar cores 5A can be divided upward and downward in two along a plane that is orthogonal to the axes thereof, and the upper halves are made integral with the ceiling plate 5B, and the lower halves are made integral with the bottom plate 5C. Further, instead of dividing the columnar cores 5A in two upward and downward, the columnar cores 5A and one of the ceiling plate 5B and the bottom plate 5C may be formed integrally, and the other of the ceiling plate 5B and the bottom plate 5C may be formed so as to be able to be separated from the columnar cores 5A.

The ceiling plate 5B and the bottom plate 5C have planar configurations that are shaped as equilateral triangles in which the vertices are rounded and each side swells in an arc shape toward the outer side. Further, the bolt insert-through hole 6 is provided in the central portion, and the fixing bolt 8 is inserted-through the bolt insert-through hole 6. Moreover, the bolt insert-through groove 7 is provided at the central portion of each side, and the fixing bolts 8 are inserted-through the bolt insert-through grooves 7 as well. However, among the fixing bolts 8, those that are inserted-through the bolt insert-through grooves 7 are not illustrated. Nuts 10 are screwed-together with the distal end portions of the fixing bolts 8, and due thereto, the upper half portion and the lower half portion of the three-legged ferrite core 5 are strongly fastened.

Three leg portions 9 for fixing the three-phase high frequency transformer 100 to a substrate are provided at the bottom surface of the bottom plate 5C.

As shown in FIG. 2A to FIG. 2C, the primary coil 11 and the secondary coil 21 are fit on one of the three columnar cores 5A, the primary coil 12 and the secondary coil 22 are fit on another one, and the primary coil 13 and the secondary coil 23 are fit on yet another one.

The primary coil 11 and the secondary coil 21, and the primary coil 12 and the secondary coil 22, and the primary coil 13 and the secondary coil 23 are all formed by winding flat wires in the counterclockwise direction as seen from above, and furthermore, edgewise. Note that the winding directions of the primary coil 11 and the secondary coil 21, and the primary coil 12 and the secondary coil 22, and the primary coil 13 and the secondary coil 23 may be the clockwise direction as seen from above.

The primary coil 11 and the secondary coil 21 are disposed such that the flat wire that structures the secondary coil 21 is interposed in the gaps of the flat wire that structures the primary coil 11, in other words, such that the flat wire that structures the primary coil 11 and the flat wire that structures the secondary coil 21 are lined-up alternately. Further, the number of turns of the primary coil 11 is greater than the secondary coil 21. Accordingly, the secondary coil 21 is fit-into the central portion of the primary coil 11, and, at the both ends of the primary coil 11, there are portions where the secondary coil 21 is not fit-in. Accordingly, because the high frequency current that is outputted from the secondary coil 21 is larger in current and lower in voltage than the high frequency current that is inputted to the primary coil 11, the flat wire that structures the secondary coil 21 has a thickness that is the same as but has a width that is wider than the flat wire that structures the primary coil 1. Note that, at the secondary coil 21, instead of using, a flat wire whose width is wider than the primary coil 11, a flat wire whose thickness is thicker may be used. The primary coil 11 and the secondary coil 21 have equal inner diameters, and are disposed such that the inner peripheries thereof coincide. Further, the inner diameters of the primary coil 11 and the secondary coil 21 are, as compared with the outer diameter of the columnar core 5A, large by an amount that provides a gap for insertion of an insulator.

Similarly, the primary coil 12 and the secondary coil 22 are disposed such that the flat wire that structures the secondary coil 22 is interposed in the gaps of the flat wire that structures the primary coil 12, in other words, such that the flat wire that structures the primary coil 12 and the flat wire that structures the secondary coil 22 are lined-up alternately. Further, the number of turns of the primary coil 12 is greater than the secondary coil 22. Accordingly, the secondary coil 22 is fit-into the central portion of the primary coil 12, and, at the both ends of the primary coil 12, there are portions where the secondary coil 22 is not fit-in. Accordingly, because the high frequency current that is outputted from the secondary coil 22 is larger in current and lower in voltage than the high frequency current that is inputted to the primary coil 12, the flat wire that structures the secondary coil 22 has a thickness that is the same as but a width that is wider than the flat wire that structures the primary coil 12. Note that, at the secondary coil 22, instead of using a flat wire whose width is wider than the primary coil 12, a flat wire whose thickness is thicker may be used. The primary coil 12 and the secondary coil 22 have equal inner diameters, and are disposed such that the inner peripheries thereof coincide. Further, the inner diameters of the primary coil 12 and the secondary coil 22 are, as compared with the outer diameter of the columnar core 5A, larger by an amount that provides a gap for insertion of an insulator.

Similarly, the primary coil 13 and the secondary coil 23 are disposed such that the flat wire that structures the secondary coil 23 is interposed in the gaps of the flat wire that structures the primary coil 13, in other words, such that the flat wire that structures the primary coil 13 and the flat wire that structures the secondary coil 23 are lined-up alternately. Further, the number of turns of the primary coil 13 is greater than the secondary coil 23. Accordingly, the secondary coil 23 is fit-into the central portion of the primary coil 13, and, at the both ends of the primary coil 13, there are portions where the secondary coil 23 is not fit-in. Accordingly, because the high frequency current that is outputted from the secondary coil 23 is large current of a lower voltage than the high frequency current that is inputted to the primary coil 13, the flat wire that structures the secondary coil 23 has a thickness that is the same as but a width that is wider than the flat wire that structures the primary coil 13. Note that, at the secondary coil 23, instead of using a flat wire whose width is wider than the primary coil 13, a flat wire whose thickness is thicker may be used. The primary coil 13 and the secondary coil 23 have equal inner diameters, and are disposed such that the inner peripheries thereof coincide. Further, the inner diameters of the primary coil 13 and the secondary coil 23 are, as compared with the outer diameter of the columnar core 5A, larger by an amount that provides a gap for insertion of an insulator.

Note that the example shown in FIG. 2A to FIG. 2C is an example of a step-down transformer, but can be made to be a step-up transformer by making the number of turns of the secondary coils 21, 22, 23 greater than the primary coils 11, 12, 13, and by making the widths of the flat wires that structure the secondary coils 21, 22, 23 more narrow than the widths of the flat wires that structure the primary coils 11, 12, 13.

The winding start portions of the primary coils 11, 12, 13 are pulled-out to the outer sides of the primary coils 11, 12, 13 and are made to be the lead lines 11A, 12A, 13A. Further, the winding end portions also are pulled-out to the outer sides of the primary coils 11, 12, 13 and are made to be the lead lines 11B, 12B, 13B.

Similarly, the winding start portions of the secondary coils 21, 22, 23 are pulled-out to the outer sides of the secondary coils 21, 22, 23 and are made to be the lead lines 21A, 22A, 23A. The winding end portions also are pulled-out to the outer sides of the secondary coils 21, 22, 23 and are made to be the lead lines 21B, 22B, 23B.

At the primary coils 11, 12, 13, the end portions of all of the lead lines 11B, 12B, 13B are bent horizontally, and are electrically connected to a connecting piece 30 that is formed from a plate-shaped conductor having a donut-shaped planar configuration. Similarly, at the secondary coils 21, 22, 23 as well, the end portions of all of the lead lines 21B, 22B, 23B are bent horizontally, and are electrically connected to a connecting piece 31 that is formed from a plate-shaped conductor having a donut-shaped planar configuration. Accordingly, both the primary coils 11, 12, 13 and the secondary coils 21, 22, 23 are Y-connected.

On the other hand, the lead lines 11A, 12A, 13A of the primary coils 11, 12, 13 are respectively connected to the U-phase, V-phase, W-phase of the input side, and the lead lines 21A, 22A, 23A of the secondary coils 21, 22, 23 are respectively connected to the U-phase, V-phase, W-phase of the output side.

Operation of the three-phase high frequency transformer 100 is described hereinafter. At the three-phase high frequency transformer 100, when three-phase high frequency current of a predetermined voltage, current and frequency is applied to the lead lines 11A, 12A, 13A, due to electromagnetic induction, the U-phase, V-phase, W-phase output, to the lead lines 21A, 22A, 23A, three-phase high frequency currents that are in voltages and currents that correspond to the turns ratios of the primary coil 11 and the secondary coil 21, the primary coil 12 and the secondary coil 22, and the primary coil 13 and the secondary coil 23.

At the three-phase high frequency transformer 100, the upper half portions of the columnar cores 5A and the ceiling plate 5B, and the lower half portions of the columnar cores 5A and the bottom plate 5C, are formed integrally, and respectively structure the upper half portion and the lower half portion of the three-legged ferrite core 5. Further, because the upper half portion and the lower half portion of the three-legged ferrite core 5 are strongly fastened by the fixing bolts 8 that are inserted-through the bolt insert-through hole 6 and the bolt insert-through grooves 7, no air gaps are formed between the columnar cores 5A and the ceiling plate 5B and the bottom plate 5C, and between the upper half portions and the lower half portions of the columnar cores 5A, and an increase in iron loss due to the existence of air gaps can be effectively suppressed.

Further, because the inner diameters of the primary coils 11, 12, 13 and the secondary coils 21, 22, 23 are equal, and further, the inner peripheries are disposed so as to coincide, the gaps between the primary coils 11, 12, 13 and the secondary coils 21, 22, 23, and the columnar cores 5A, are narrow, and therefore, even when used at high frequencies, a high conversion efficiency can be achieved.

Moreover, because both the primary coils 11, 12, 13 and the secondary coils 21, 22, 23 are Y-connected, at both the primary coils 11, 12, 13 and the secondary coils 21, 22, 23, the respective interphase voltages are $1/\sqrt{3}$ of the voltage between the primary lines and the voltage between the secondary lines, and the numbers of turns of the primary coils 11, 12, 13 and the secondary coils 21, 22, 23 that are wound around the columnar cores 5A also respectively are $1/\sqrt{3}$ and are small. Therefore, a three-phase high frequency transformer, which can be constituted compactly and furthermore by which large electric power can be handled, is provided.

3. Embodiment 3

Of the three-phase high frequency transformers of the present invention, a second example in which both the primary coils and the secondary coils are Y-connected is described hereinafter.

Figure 3A:
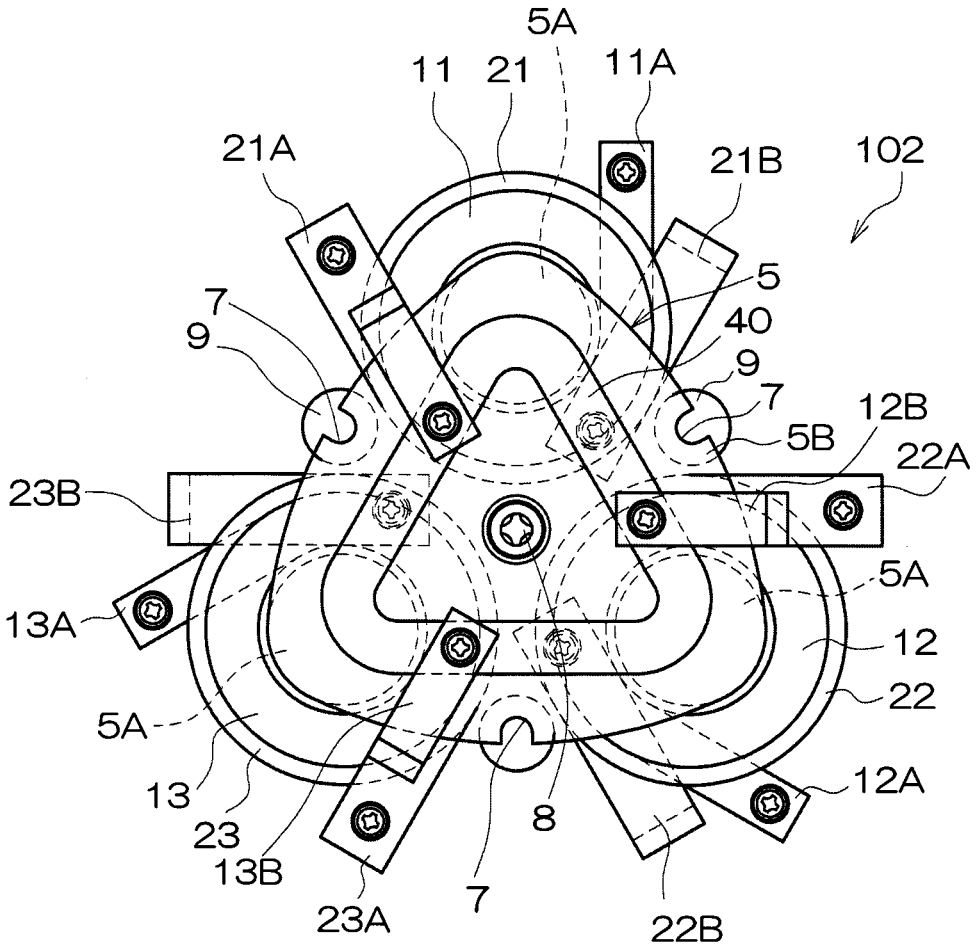
FIG. 3A is a plan view showing the structure of a three-phase high frequency transformer relating to embodiment 3.
Figure 3B:
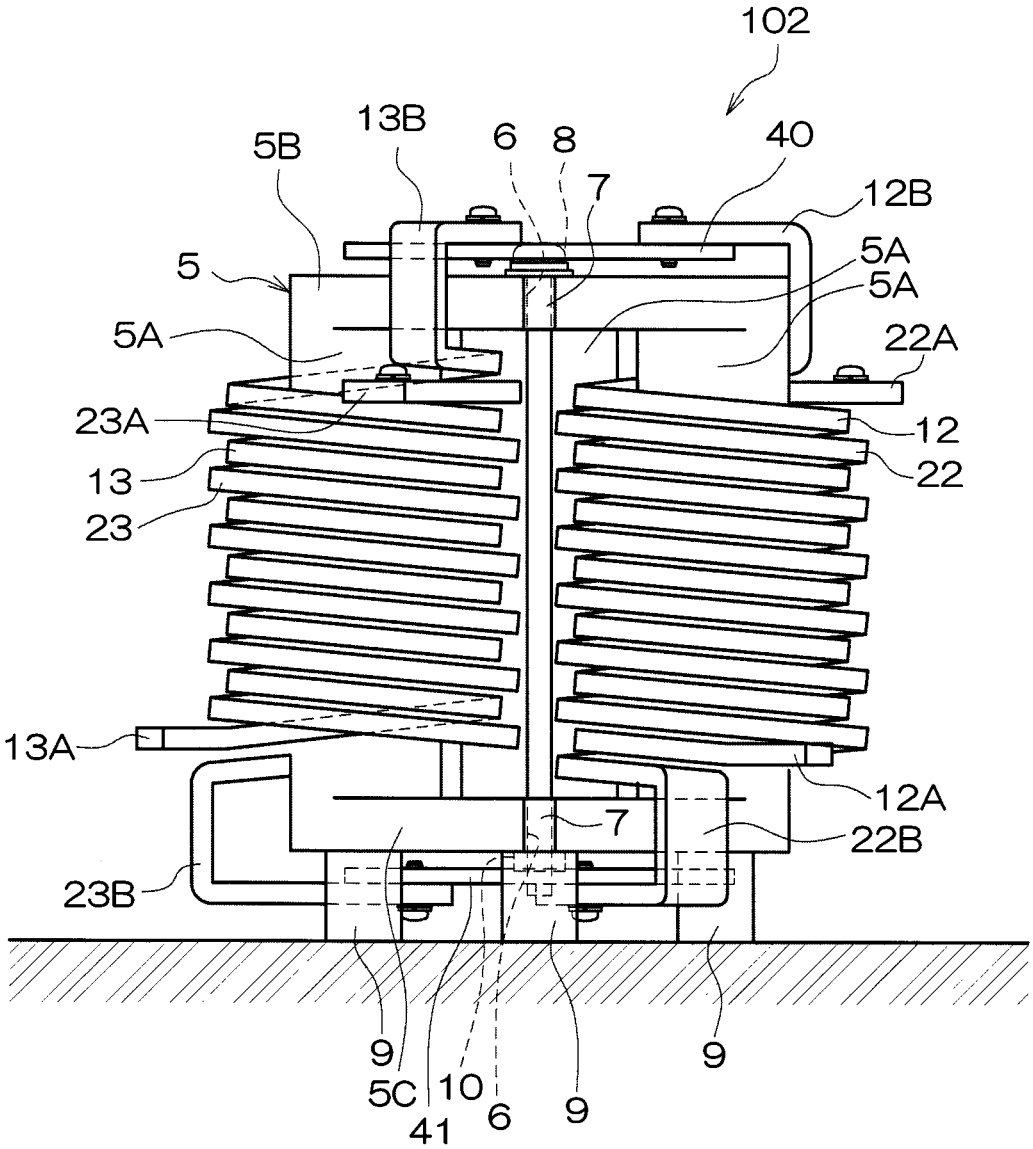
FIG. 3B is a side view showing the structure of the three-phase high frequency transformer relating to embodiment 3.
Figure 3C:
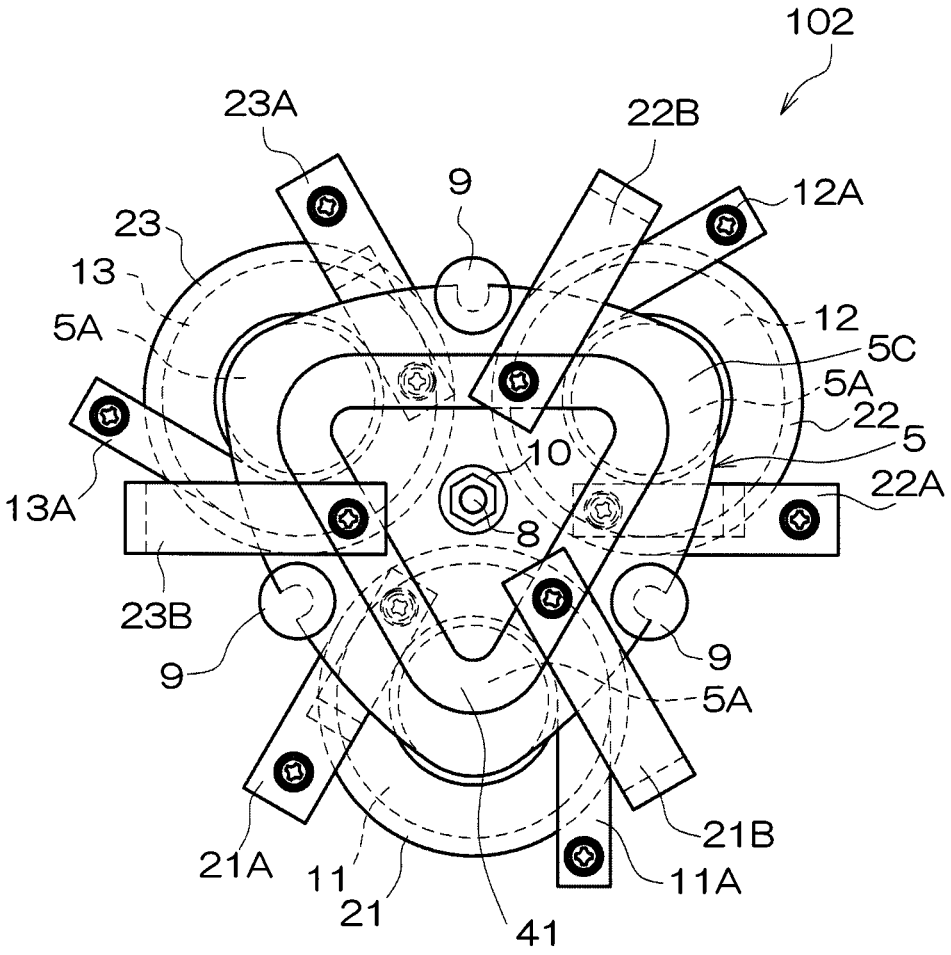
FIG. 3C is a bottom view showing the structure of the three-phase high frequency transformer relating to embodiment 3.

As shown in FIG. 3A to FIG. 3C, a three-phase high frequency transformer 102 relating to embodiment 3 has a similar structure as the three-phase high frequency transformer 100 of embodiment 1 except that a connecting member 40, that is formed from a plate-shaped conductor and has a triangular outer periphery whose respective vertices are rounded and in whose central portion is provided an opening portion of a similar shape as the outer periphery, is used as the connecting member that connects the lead lines 11B, 12B, 13B of the primary coils 11, 12, 13 instead of the connecting member 30 in embodiment 1, and the lead lines 21B, 22B, 23B of the secondary coils 21, 22, 23 are connected at a connecting member 41 that similarly is formed from a plate-shaped conductor and has a planar configuration that is similar to the connecting member 40. Further, the operation as well is similar.

4. Embodiment 4

Of the three-phase high frequency transformers of the present invention, a third example in which both the primary coils and the secondary coils are Y-connected is described hereinafter.

Figure 4A:
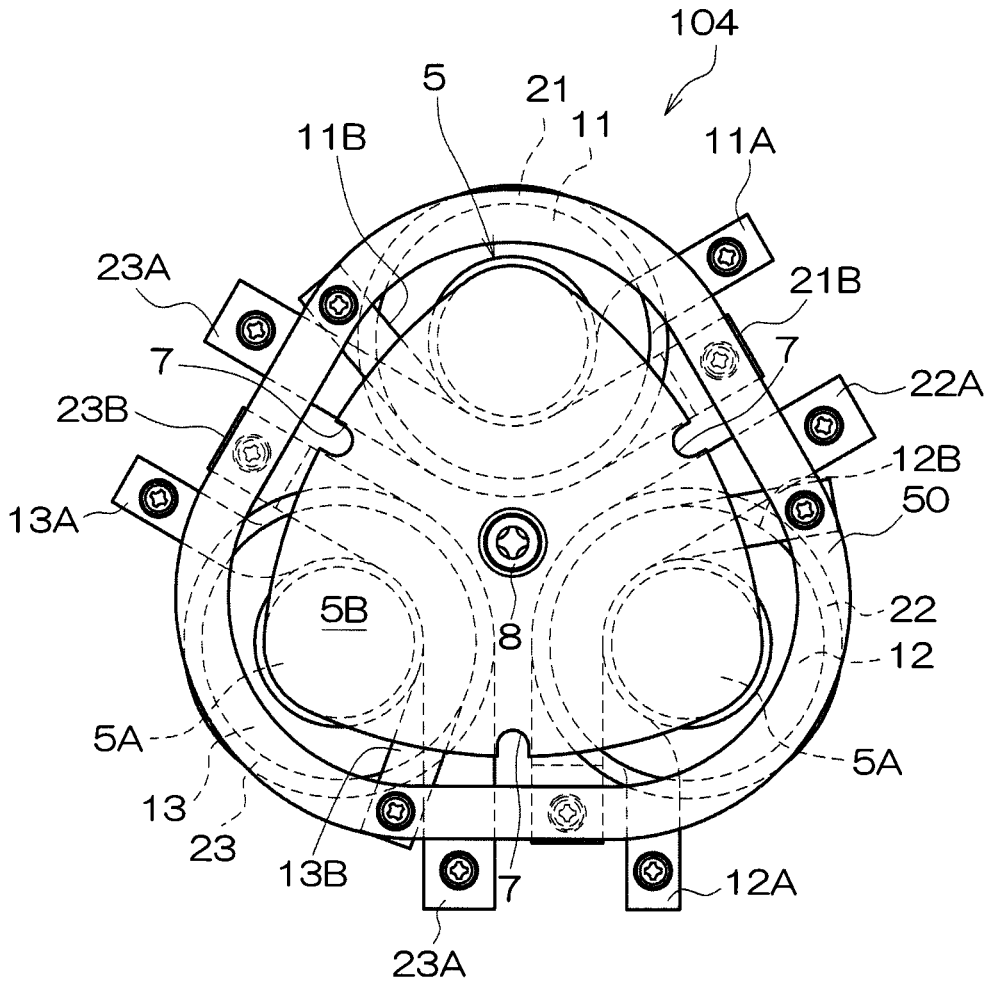
FIG. 4A is a plan view showing the structure of a three-phase high frequency transformer relating to embodiment 4.
Figure 4B:
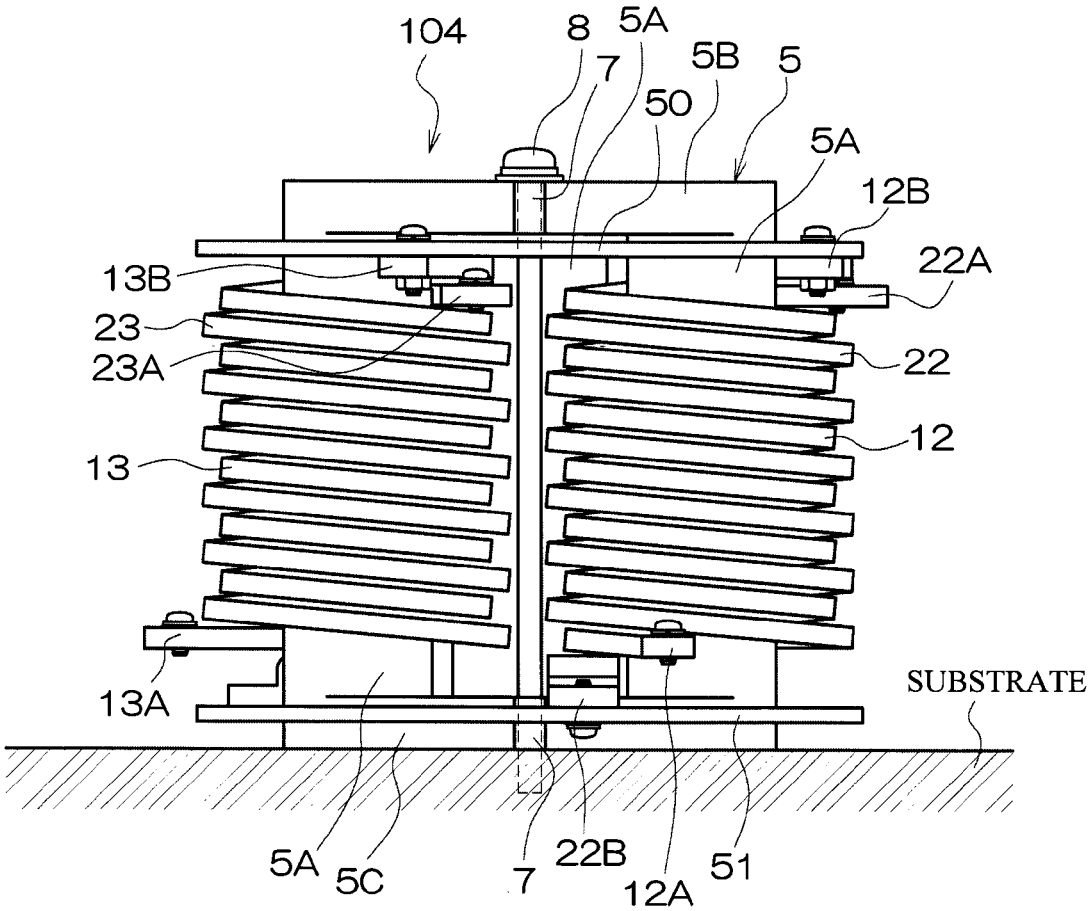
FIG. 4B is a side view showing the structure of the three-phase high frequency transformer relating to embodiment 4.
Figure 4C:
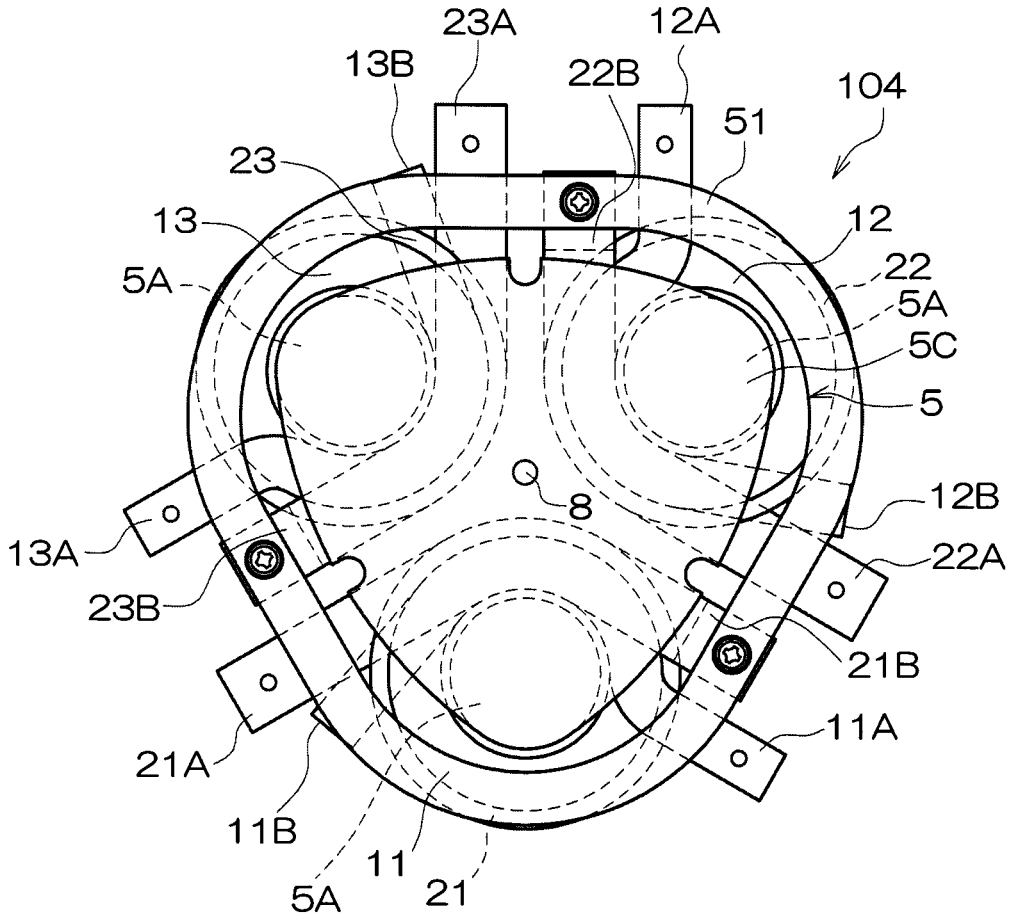
FIG. 4C is a bottom view showing the structure of the three-phase high frequency transformer relating to embodiment 4.

In a three-phase high frequency transformer 104 relating to embodiment 4, differently from the three-phase high frequency transformer 100 of embodiment 1 and the three-phase high frequency transformer 102 of embodiment 3, the final ends of the lead lines 11B, 12B, 13B of the primary coils 11, 12, 13 are not bent in the vertical direction and are, while still in an winding end state, connected by a connecting member 50 in a vicinity of the ceiling plate 5B as shown in FIG. 4A to FIG. 4C. Similarly, the final ends of the lead lines 21B, 22B, 23B of the secondary coils 21, 22, 23 as well also are not bent in the vertical direction, and are, while still in an winding end state, connected by a connecting member 51 in a vicinity of the floor plate 5C.

Both of the connecting members 50, 51 are formed from plate-shaped conductors, and have triangular outer peripheries whose respective vertices are rounded, and an opening portion of a similar configuration as the outer periphery is provided in the central portions thereof. However, the connecting members 50, 51 are positioned at the outer side of the ceiling plate 5B or the bottom plate 5C, respectively.

Further, the three-phase high frequency transformer 104 does not have the leg portions 9, and instead, the bottom plate 5C is directly placed on a substrate, and the fixing bolts 8 are screwed-together with screw holes provided in the substrate. Accordingly, the nuts 10 for fastening the upper half portion and the lower half portion of the three-legged ferrite core 5 are not needed.

In addition to the features that the three-phase high frequency transformer 100 of embodiment 1 and the three-phase high frequency transformer 102 of embodiment 3 have, the three-phase high frequency transformer 104 has the feature that the post-processing of the lead lines 11B, 12B, 13B of the primary coils 11, 12, 13 and the lead lines 21B, 22B, 23B of the secondary coils 21, 22, 23 can be greatly simplified, and further, has the feature that the overall structure itself also can be simplified because the nuts 10 that screw-together with the fixing bolts 8 can be omitted.

5. Embodiment 5

Of the three-phase high frequency transformers of the present invention, a fourth example in which both the primary coils and the secondary coils are Y-connected is described hereinafter.

Figure 5A:
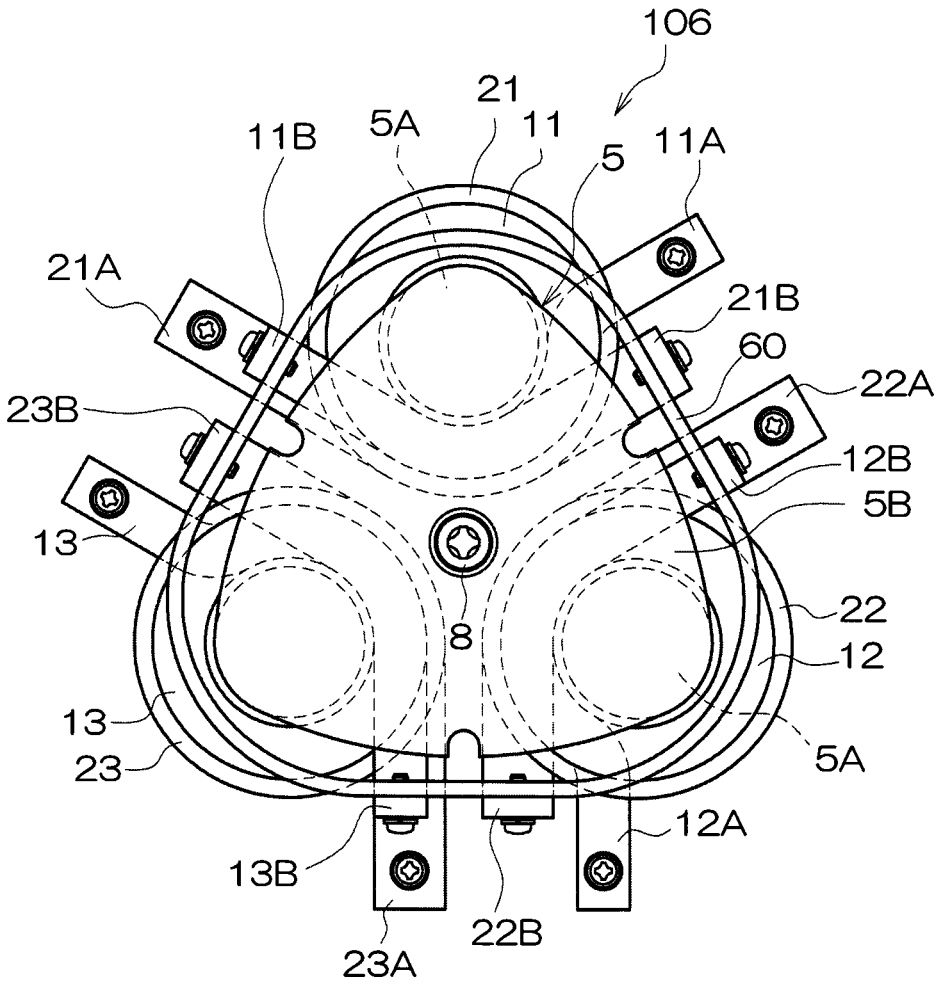
FIG. 5A is a plan view showing the structure of a three-phase high frequency transformer relating to embodiment 5.
Figure 5B:
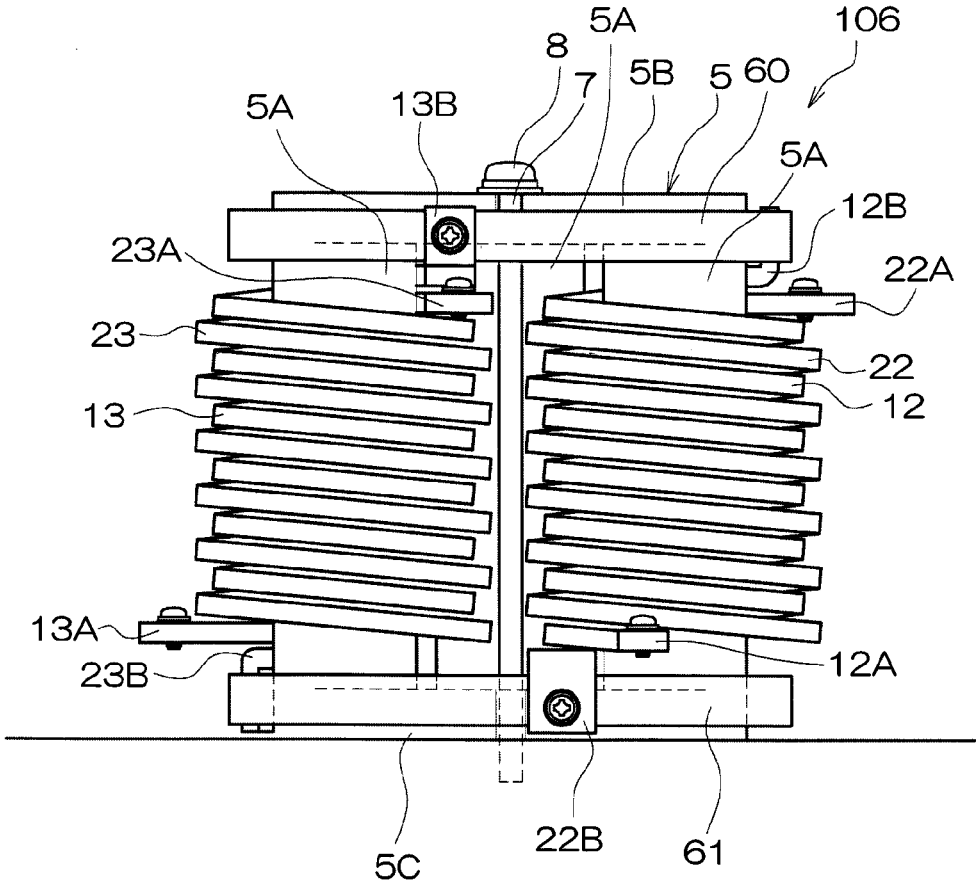
FIG. 5B is a side view showing the structure of the three-phase high frequency transformer relating to embodiment 5.
Figure 5C:
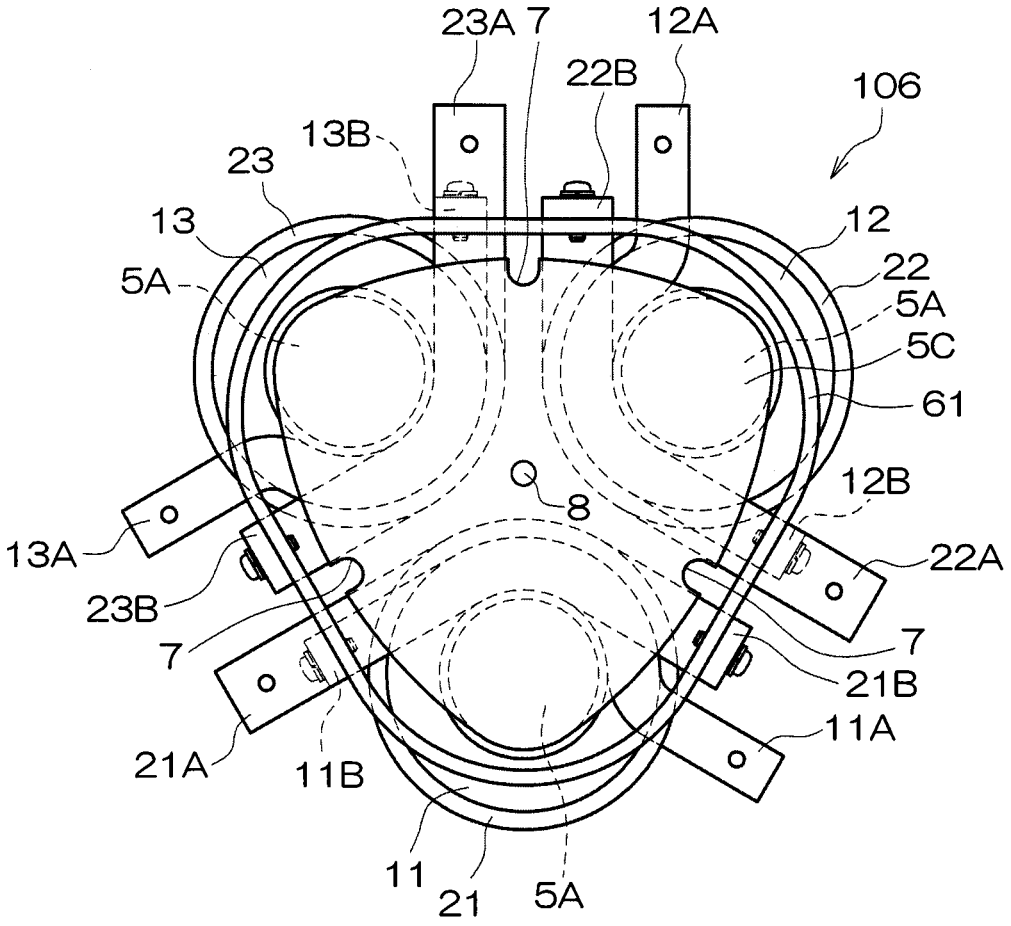
FIG. 5C is a bottom view showing the structure of the three-phase high frequency transformer relating to embodiment 5.

In a three-phase high frequency transformer 106 relating to embodiment 5, differently from the three-phase high frequency transformer 100 of embodiment 1 and the three-phase high frequency transformer 102 of embodiment 3, the final ends of the lead lines 11B, 12B, 13B of the primary coils 11, 12, 13 are bent upward and are connected by a connecting member 60 in a vicinity of the ceiling plate 5B as shown in FIG. 5A to FIG. 5C. On the other hand, the final ends of the lead lines 21B, 22B, 23B of the secondary coils 21, 22, 23 are bent downward and are connected by a connecting member 61 in a vicinity of the floor plate 5C.

The connecting members 60, 61 have triangular planar shapes whose respective vertices are rounded, and are formed by bending strips that are conductors into this shape. The connecting members 60, 61 are positioned at the outer side of the ceiling plate 5B or the bottom plate 5C, respectively.

Further, the three-phase high frequency transformer 106 does not have the leg portions 9, and instead, the bottom plate 5C is directly placed on a substrate, and the fixing bolts 8 are screwed-together with screw holes provided in the substrate. Accordingly, the nuts 10 for fastening the upper half portion and the lower half portion of the three-legged ferrite core 5 are not needed.

In addition to the feature that the overall structure itself also can be simplified because the nuts 10 that screw-together with the fixing bolts 8 can be omitted, the three-phase high frequency transformer 106 also has the feature that, because the connecting members 60, 61 can be formed by bending strips that are conductors, manufacturing is easier as compared with the connecting members 50, 51 that require punching by a press or the like.

6. Embodiment 6

Of the three-phase high frequency transformers of the present invention, a fifth example in which both the primary coils and the secondary coils are Y-connected is described hereinafter.

Figure 6A:
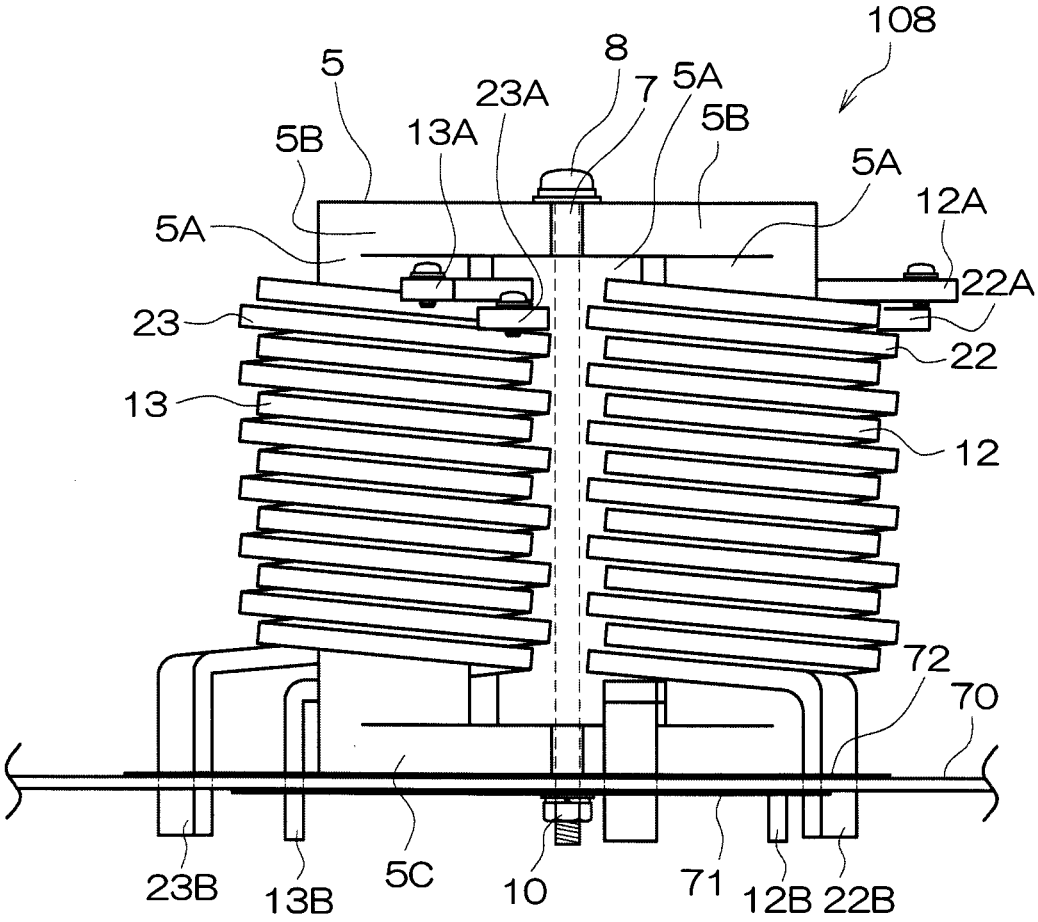
FIG. 6A is a side view showing the structure of a three-phase high frequency transformer relating to embodiment 6.
Figure 6B:
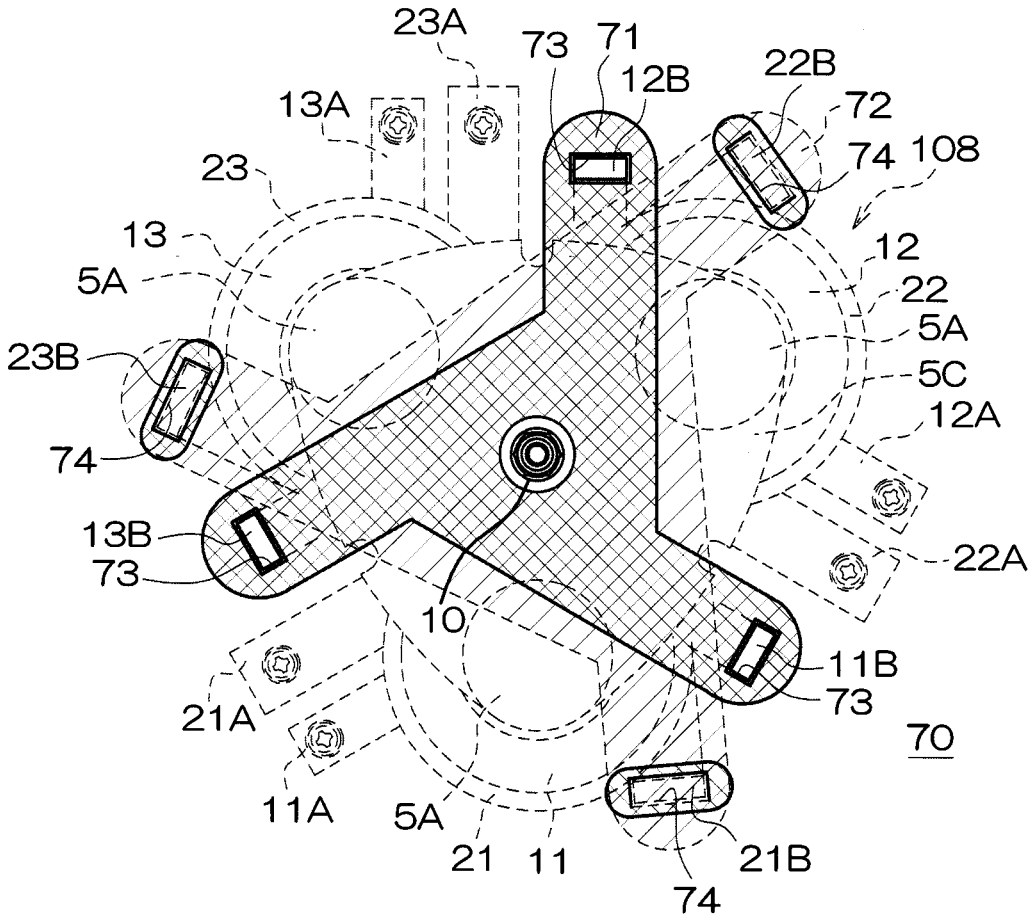
FIG. 6B is a bottom view when viewing the three-phase high frequency transformer relating to embodiment 6 from the reverse side of a printed substrate.

In a three-phase high frequency transformer 108 relating to embodiment 6, as shown in FIG. 6A and FIG. 6B, the final ends of the lead lines 11B, 12B, 13B of the primary coils 11, 12, 13 and the final ends of the lead lines 21B, 22B, 23B of the secondary coils 21, 22, 23 are bent downward. Further, the lead lines 11B, 12B, 13B are inserted in opening portions 73 that are provided in a printed circuit board 70, and the lead lines 21B, 22B, 23B are inserted in opening portions 74 that are provided in the printed circuit board 70. Here, a connected pattern 71 is formed at the portions where the opening portions 73 are formed at the reverse (bottom surface) of the printed circuit board 70, so as to connect the three opening portions 73, and a connected pattern 72 is formed at the portions where the opening portions 74 are formed at the obverse (top surface) of the printed circuit board 70, so as to connect the three opening portions 74. Further, the lead lines 11B, 12B, 13B are soldered to the connected pattern 71 at the opening portions 73, and the lead lines 21B, 22B, 23B are soldered to the connected pattern 72 at the opening portions 74. Due thereto, the lead lines 11B, 12B, 13B are connected at the connected pattern 71, and the lead lines 21B, 22B, 23B are connected at the connected pattern 72.

Further, the fixing bolt 8 is inserted-through a hole provided in the printed circuit board 70, and the nut 10 is screwed-together from the reverse side of the printed circuit board 70.

At the three-phase high frequency transformer 108, the structures and the like of the three-legged ferrite core 5, the primary coils 11, 12, 13 and the secondary coils 21, 22, 23 are the same as the three-phase high frequency transformer 100 of embodiment 1.

The three-phase high frequency transformer 108 has a feature of being easily mounted on the printed circuit board 70 in addition to the feature of the three-phase high frequency transformer 100 of the first embodiment.

Note that, in the example shown in FIG. 6A and FIG. 6B, the connected pattern 71 that connects the primary coils 11, 12, 13 is formed at the bottom surface of the printed circuit board 70, and the connected pattern 72 that connects the secondary coils 21, 22, 23 is formed at the top surface of the printed circuit board 70, but, on the contrary, the connected pattern 71 may be formed at the top surface of the printed circuit board 70 and the connected pattern 72 may be formed at the bottom surface of the printed circuit board 70.

7. Embodiment 7

Of the three-phase high frequency transformers of the present invention, a sixth example in which both the primary coils and the secondary coils are Y-connected is described hereinafter.

Figure 7A:
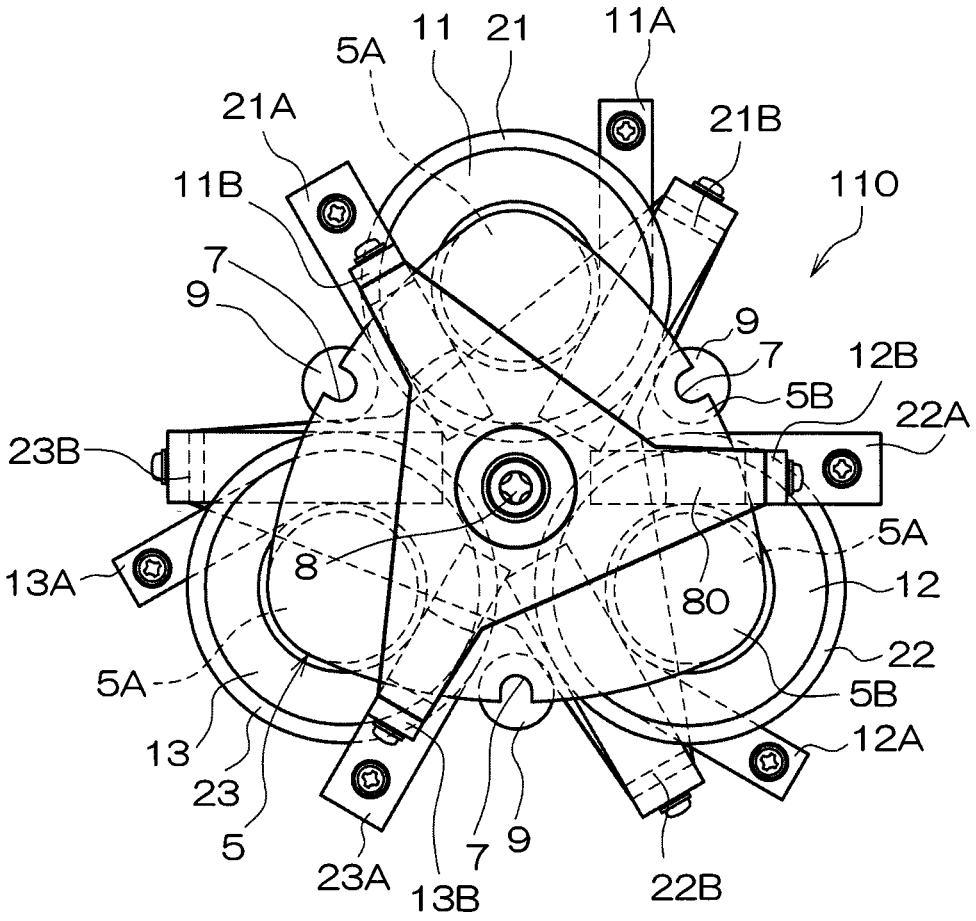
FIG. 7A is a plan view showing the structure of a three-phase high frequency transformer relating to embodiment 7.
Figure 7B:
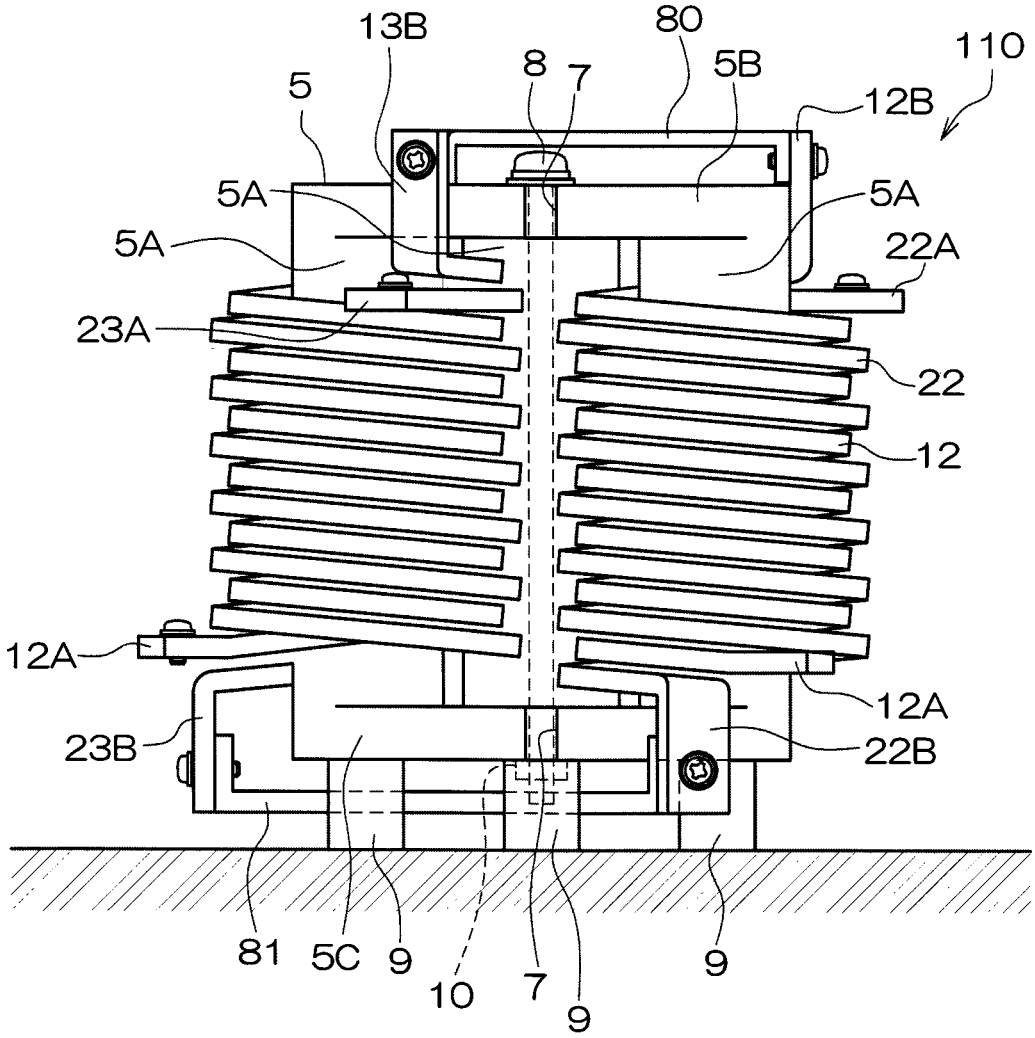
FIG. 7B is a side view showing the structure of the three-phase high frequency transformer relating to embodiment 7.
Figure 7C:
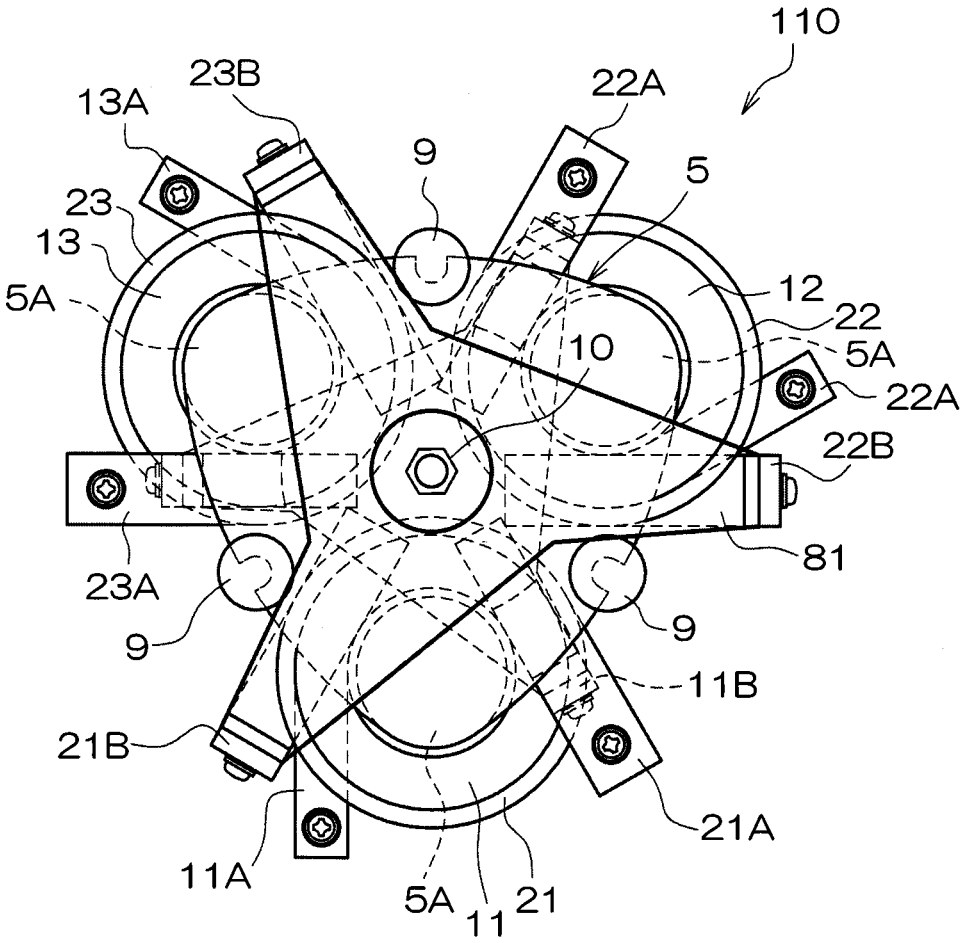
FIG. 7C is a bottom view showing the structure of the three-phase high frequency transformer relating to embodiment 7.

In a three-phase high frequency transformer 110 relating to embodiment 7, as shown in FIG. 7A to FIG. 7C, the final ends of the lead lines 11B, 12B, 13B of the primary coils 11, 12, 13 are bent upward, and the final ends of the lead lines 21B, 22B, 23B of the secondary coils 21, 22, 23 are bent downward, and they are connected at connecting members 80, 81 that are substantially triangular. The connecting members 80, 81 are both triangular shapes whose ridge portions project-out to the outer sides. The distal ends of the ridge portions of the connecting member 80 are bent downward and are connected to the lead lines 11B, 12B, 13B, and the distal ends of the ridge portions of the connecting member 81 are bent upward and are connected to the lead lines 21B, 22B, 23B.

Other than the above-described points, the three-phase high frequency transformer 110 has the same structure as the three-phase high frequency transformer 100 of embodiment 1.

8. Embodiment 8

Of the three-phase high frequency transformers of the present invention, an example in which the primary coils are Δ-connected and the secondary coils are Y-connected is described hereinafter.

Figure 8A:
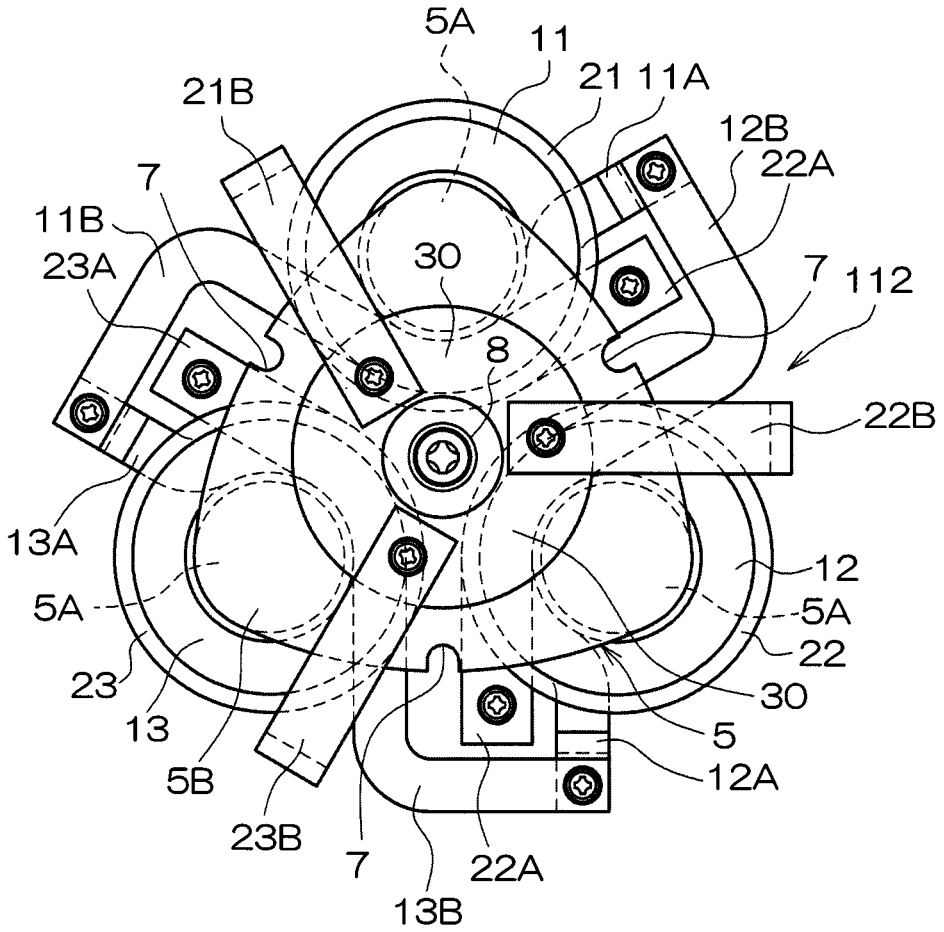
FIG. 8A is a plan view showing the structure of a three-phase high frequency transformer relating to embodiment 8.
Figure 8B:
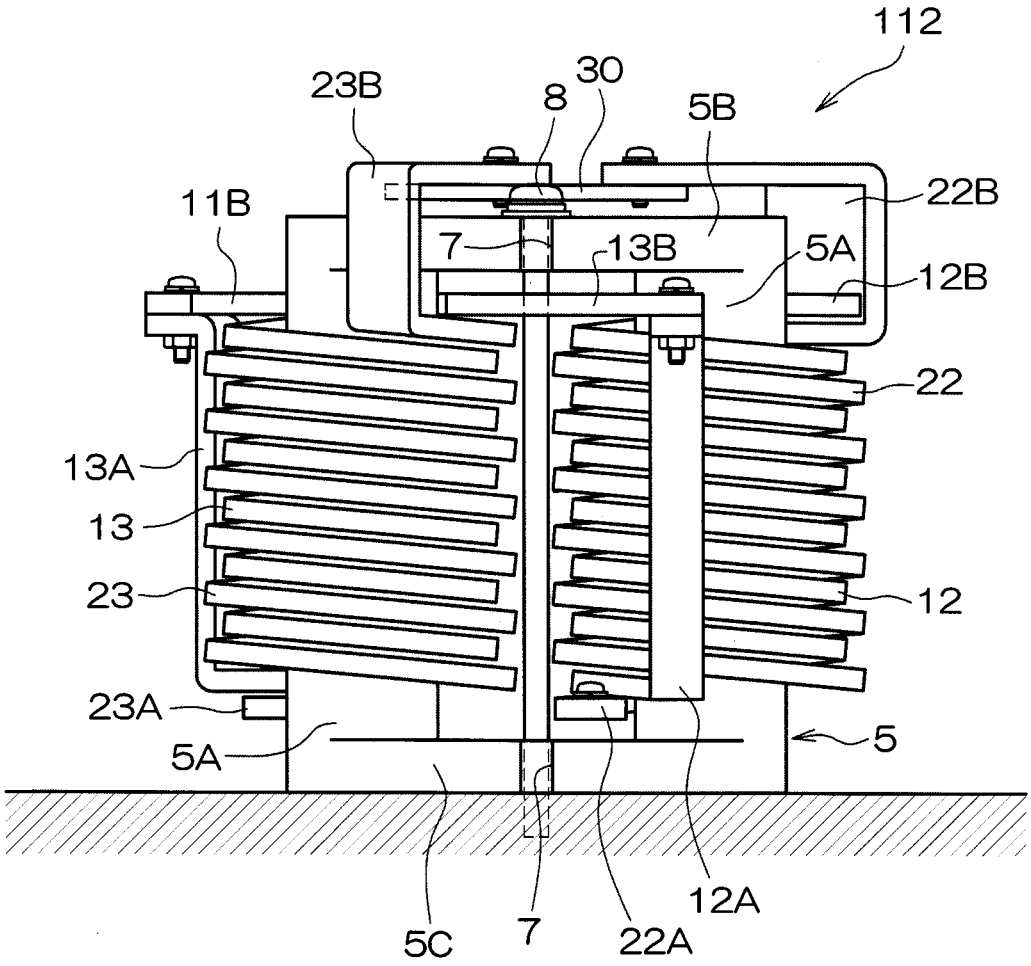
FIG. 8B is a side view showing the structure of the three-phase high frequency transformer relating to embodiment 8.

In a three-phase high frequency transformer 112 relating to embodiment 8, as shown in FIG. 8A and FIG. 8B, the primary coils 11, 12, 13 are all formed by winding flat wires upward from bottom to top, and the winding start portions are made to be the lead lines 11A, 12A, 13A respectively, and the winding end portions are made to be the lead lines 11B, 12B, 13B respectively.

The lead lines 11A, 12A, 13A of the winding start sides are respectively bent upward, and the final ends thereof are at substantially the same height as the lead lines 11B, 12B, 13B of the winding end sides. Further, the lead line 11B at the winding end side of the primary coil 11 is connected to the lead line 13A at the winding start side of the primary coil 13, the lead line 13B at the winding end side of the primary coil 13 is connected to the lead line 12A at the winding start side of the primary coil 12, and the lead line 12B at the winding end side of the primary coil 12 is connected to the lead line 11A at the winding start side of the primary coil 11. Further, the connected portion of the lead line 11B and the lead line 13A, the connected portion of the lead line 13B and the lead line 12A, and the connected portion of the lead line 12B and the lead line 11A are connected to the U-phase, the V-phase, the W-phase of the input side respectively. Accordingly, the primary coils 11, 12, 13 are Δ-connected.

On the other hand, the secondary coils 21, 22, 23 are formed by winding flat wires, whose width is wider than the primary coils 11, 12, 13, upward from bottom to top, and the winding start portions are made to be the lead lines 21A, 22A, 23A respectively, and the winding end portions are made to be the lead lines 21B, 22B, 23B respectively. Note that the example shown in FIG. 8A and FIG. 8B is an example of a step-down transformer, but if it is made to be a step-up transformer, it suffices to use flat wires of a narrower width than the primary coils 11, 12, 13 as the secondary coils 21, 22, 23.

Further, the lead lines 21B, 22B, 23B of the winding end sides are respectively bent upward, and further, at the final end portions, are bent horizontally so as to be directed inward, and are connected to the connecting member 30. The connecting member 30 is as described in embodiment 1.

On the other hand, the lead lines 21A, 22A, 23A of the winding start sides are connected to the U-phase, the V-phase, the W-phase of the output side, respectively. Accordingly, the secondary coils 21, 22, 23 are Y-connected.

Other than the above-described points, the three-phase high frequency transformer 112 has the same structure as the three-phase high frequency transformer 100 of embodiment 1.

At the three-phase high frequency transformer 112 as well, the upper half portions of the columnar cores 5A and the ceiling plate 5B, and the lower half portions of the columnar cores 5A and the bottom plate 5C are formed integrally, and respectively structure the upper half portion and the lower half portion of the three-legged ferrite core 5. Further, because the upper half portion and the lower half portion of the three-legged ferrite core 5 are strongly fastened by the fixing bolts 8 that are inserted-through the bolt insert-through hole 6 and the bolt insert-through grooves 7, no air gaps are formed between the columnar cores 5A and the ceiling plate 5B and the bottom plate 5C, and between the upper half portions and the lower half portions of the columnar cores 5A, and therefore, an increase in iron loss due to the existence of air gaps can be effectively suppressed.

Further, because the inner diameters of the primary coils 11, 12, 13 and the secondary coils 21, 22, 23 are equal, and further, the inner peripheries are disposed so as to coincide, the gaps between the primary coils 11, 12, 13 and the secondary coils 21, 22, 23, and the columnar cores 5A, are narrow, and therefore, even when used at high frequencies, a high conversion efficiency can be achieved.

Moreover, because the primary coils 11, 12, 13 are Δ-connected and the secondary coils 21, 22, 23 are Y-connected, the three-phase high frequency transformer 112 is suited as a transformer for step-up. Further, there is also the advantage that, when high frequency waves are included in the input, the high frequency waves circulate through the primary coils 11, 12, 13 that are Δ-connected, and therefore, the high frequency waves do not mix with the output waves.

9. Embodiment 9

Of the three-phase high frequency transformers of the present invention, a second example in which the primary coils are Δ-connected and the secondary coils are Y-connected is described hereinafter.

Figure 9A:
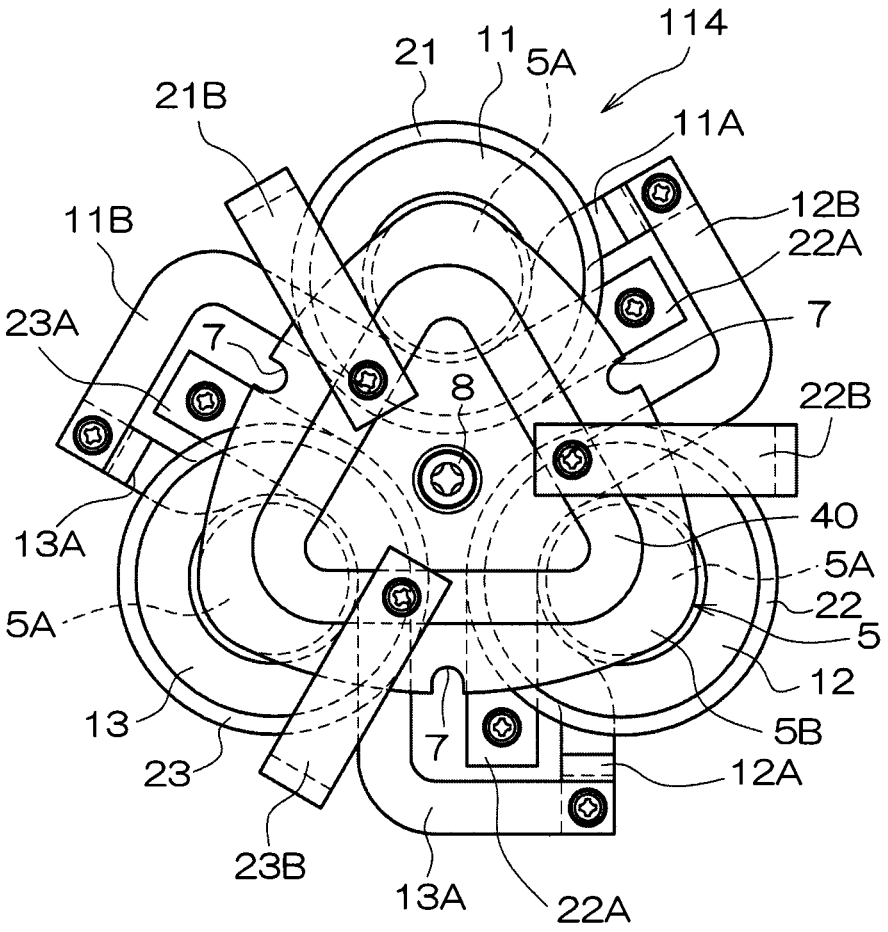
FIG. 9A is a plan view showing the structure of a three-phase high frequency transformer relating to embodiment 9.
Figure 9B:
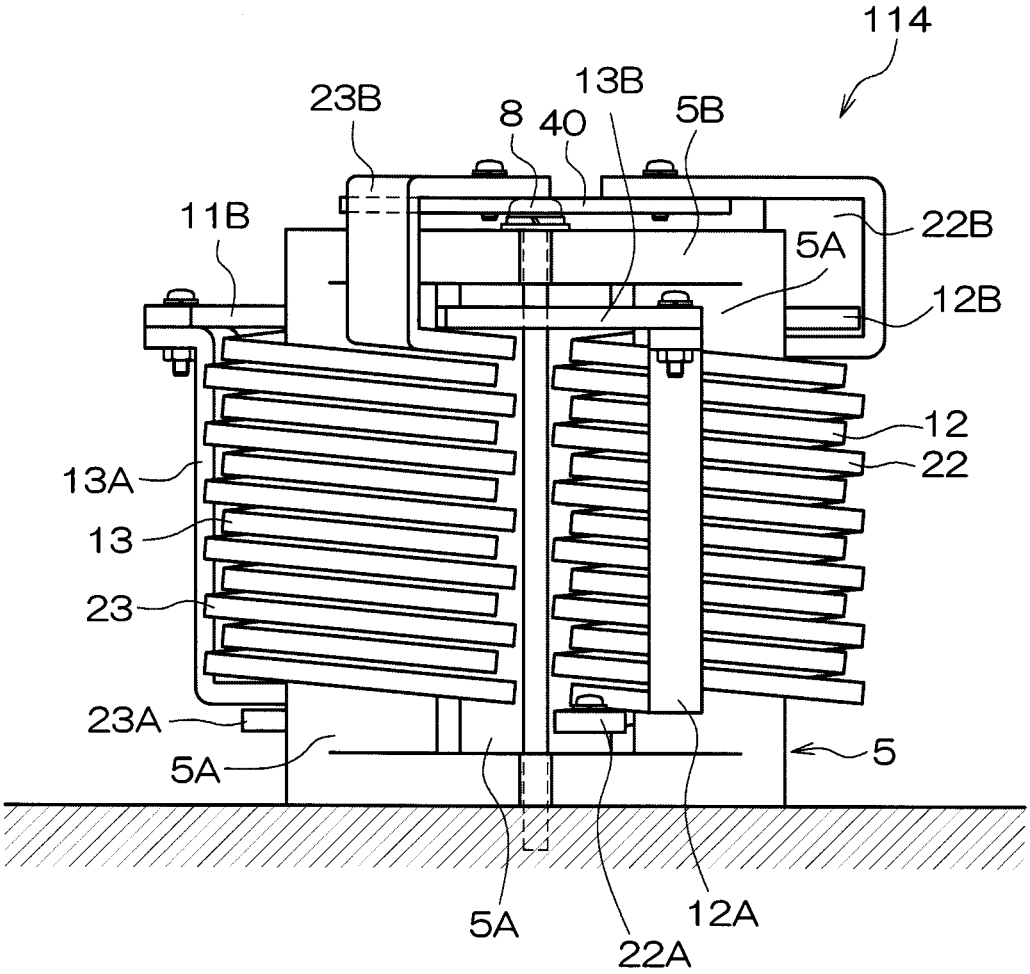
FIG. 9B is a side view showing the structure of the three-phase high frequency transformer relating to embodiment 9.

A three-phase high frequency transformer 114 relating to embodiment 9 has a similar structure as the three-phase high frequency transformer 112 of embodiment 8 except that, as shown in FIG. 9A and FIG. 9B, the connecting member 40, that is formed from a plate-shaped conductor and has a triangular outer periphery whose respective vertices are rounded and in whose central portion is provided an opening portion of a similar shape as the outer periphery, is used as the connecting member that connects the lead lines 21B, 22B, 23B of the secondary coils 21, 22, 23, instead of the connecting member 30 in embodiment 8. Further, the operation as well is similar.

10. Embodiment 10

Of the three-phase high frequency transformers of the present invention, a third example in which the primary coils are Δ-connected and the secondary coils are Y-connected is described hereinafter.

Figure 10A:
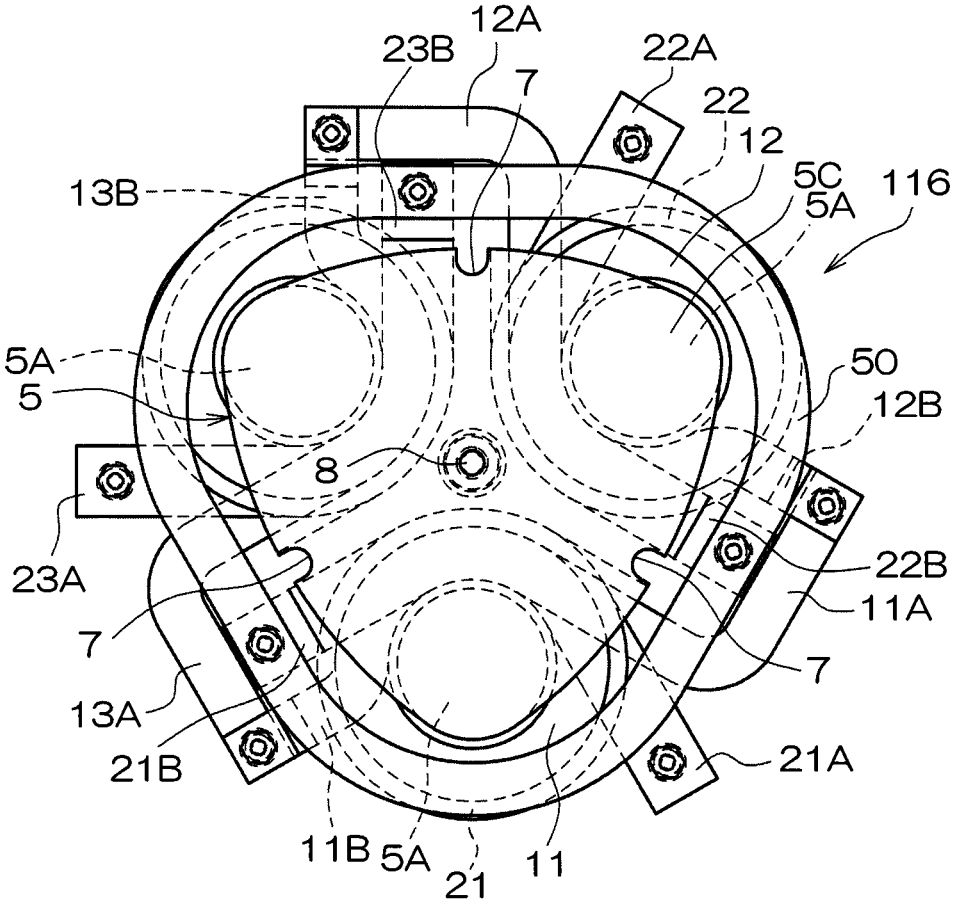
FIG. 10A is a bottom view showing the structure of a three-phase high frequency transformer relating to embodiment 10.
Figure 10B:
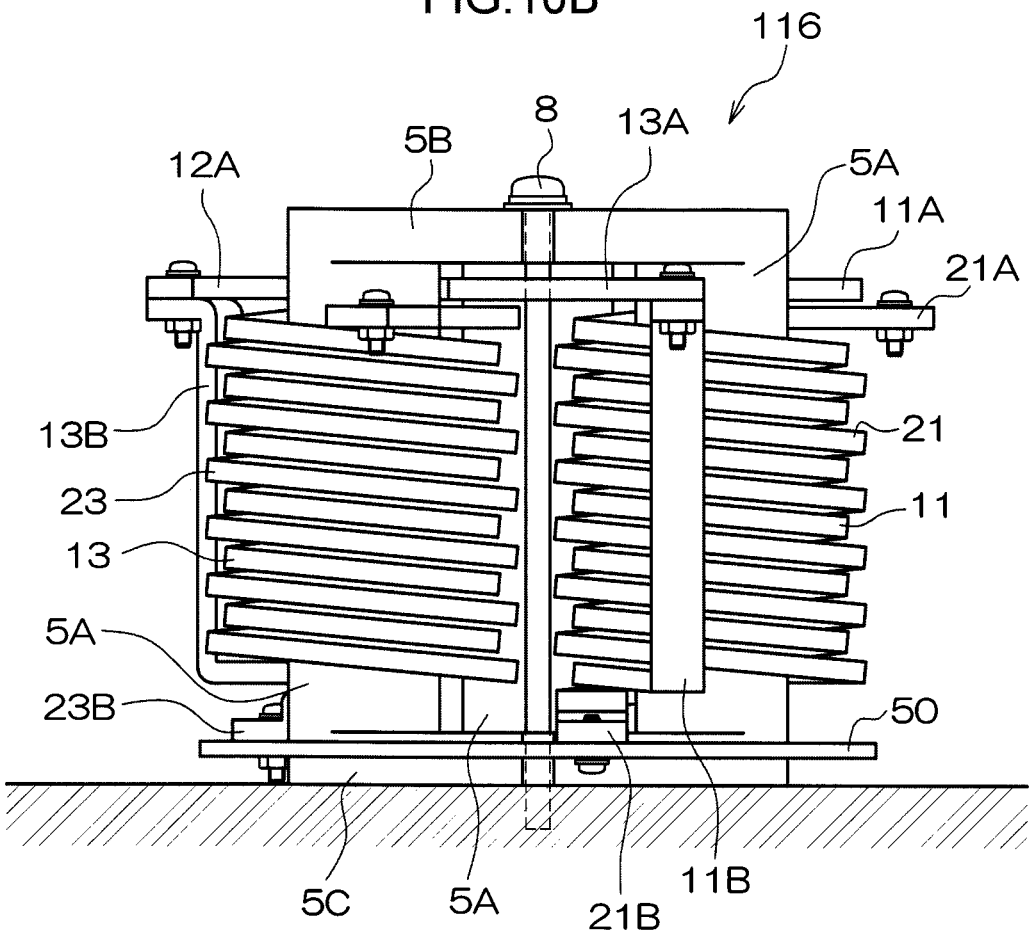
FIG. 10B is a side view showing the structure of the three-phase high frequency transformer relating to embodiment 10.

In a three-phase high frequency transformer 116 relating to embodiment 10, differently from the three-phase high frequency transformer 112 of embodiment 8 and the three-phase high frequency transformer 114 of embodiment 9, the final ends of the lead lines 21B, 22B, 23B of the secondary coils 21, 22, 23 also are not bent in the vertical direction and are, while still in an winding end state, connected by the connecting member 50 in a vicinity of the floor plate 5C as shown in FIG. 10A and FIG. 10B.

The connecting member 50 is formed from a plate-shaped conductor, and has a triangular outer periphery whose respective vertices are rounded, and an opening portion of a similar configuration as the outer periphery is provided in the central portion thereof. However, the connecting member 50 is positioned at the outer side of the bottom plate 5C.

Further, the three-phase high frequency transformer 116 does not have the leg portions 9, and instead, the bottom plate 5C is directly placed on a substrate, and the fixing bolts 8 are screwed-together with screw holes provided in the substrate. Accordingly, the nuts 10 for fastening the upper half portion and the lower half portion of the three-legged ferrite core 5 are not needed.

At the three-phase high frequency transformer 116, the structures of the three-legged ferrite core 5, the primary coils 11, 12, 13, and the secondary coils 21, 22, 23, and the connection of the lead lines 11A, 11B, 12A, 12B, 13A, 13B of the primary coils 11, 12, 13, are the same as the three-phase high frequency transformer 112 of embodiment 8.

In addition to the features that the three-phase high frequency transformer 112 of embodiment 8 and the three-phase high frequency transformer 114 of embodiment 9 have, the three-phase high frequency transformer 116 has the feature that the post-processing of the lead lines 21B, 22B, 23B of the secondary coils 21, 22, 23 can be greatly simplified, and further, has the feature that the overall structure itself also can be simplified because the nuts 10 that screw-together with the fixing bolts 8 can be omitted.

11. Embodiment 11

Of the three-phase high frequency transformers of the present invention, a fourth example in which the primary coils are Δ-connected and the secondary coils are Y-connected is described hereinafter.

Figure 11A:
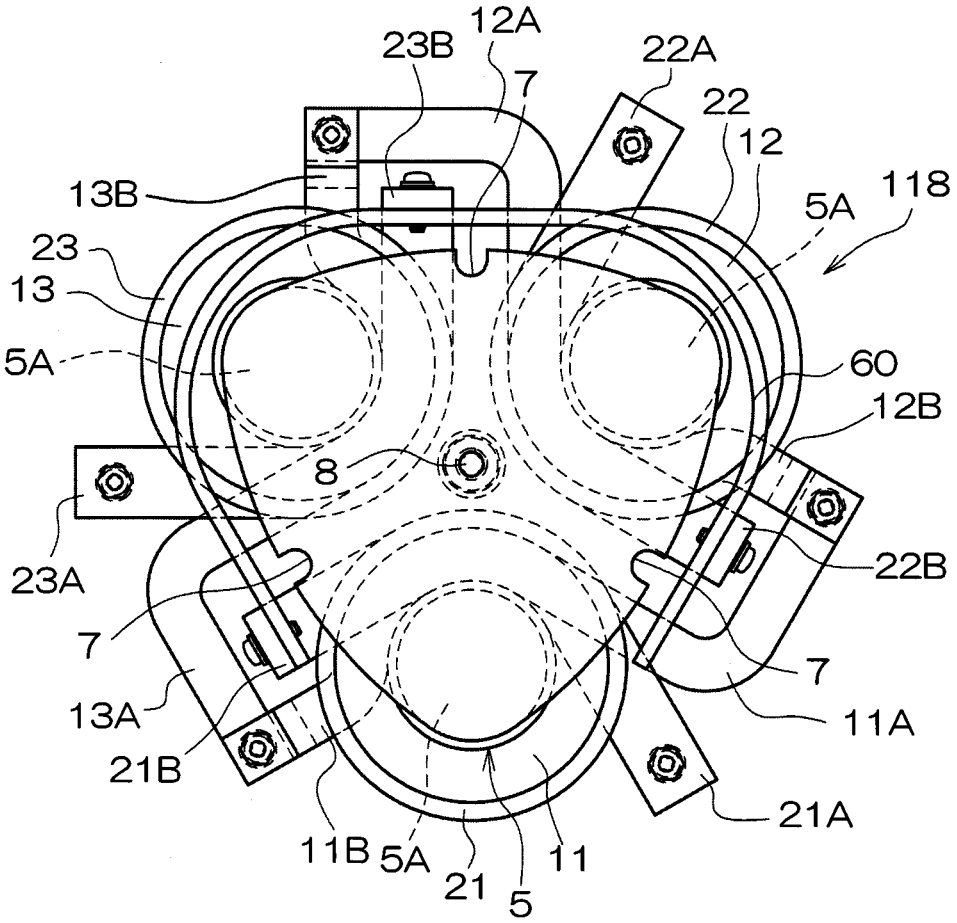
FIG. 11A is a bottom view showing the structure of a three-phase high frequency transformer relating to embodiment 11.
Figure 11B:
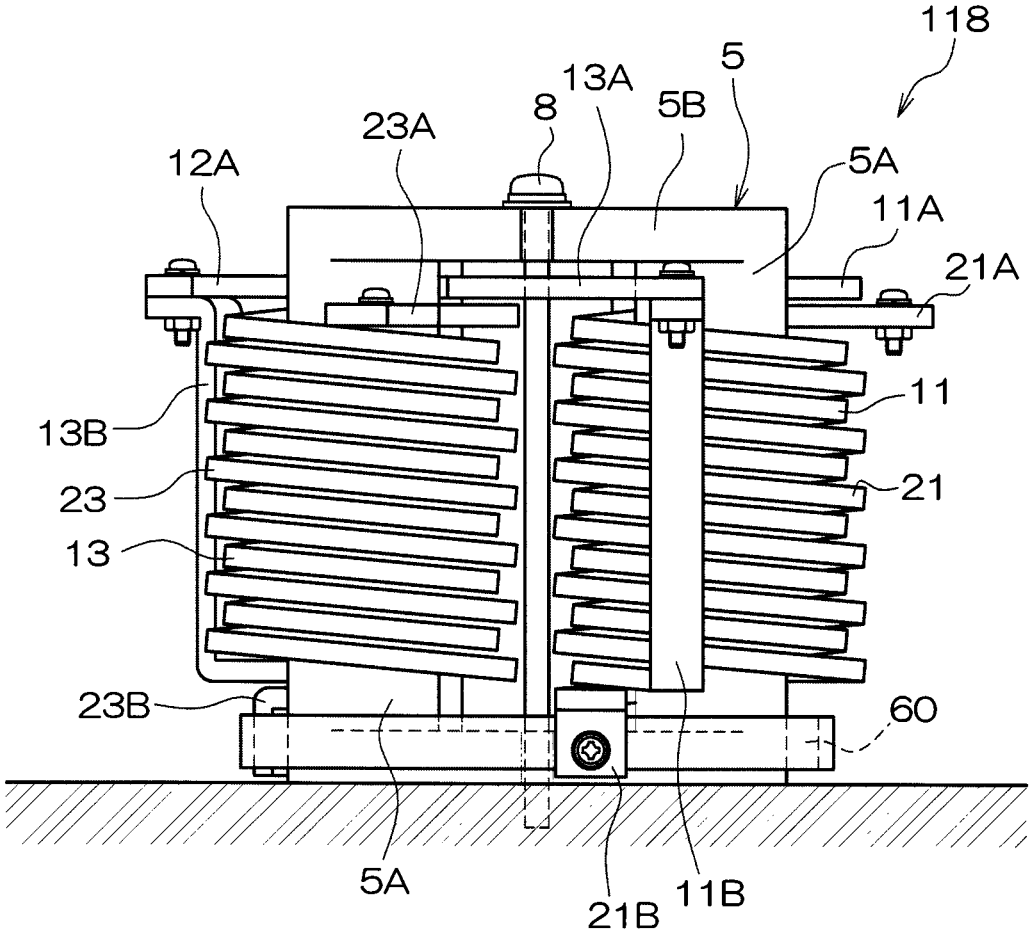
FIG. 11B is a side view showing the structure of the three-phase high frequency transformer relating to embodiment 11.

In a three-phase high frequency transformer 118 relating to embodiment 11, differently from the three-phase high frequency transformer 112 of embodiment 8 and the three-phase high frequency transformer 114 of embodiment 9, the final ends of the lead lines 21B, 22B, 23B of the secondary coils 21, 22, 23 are bent downward and are connected by the connecting member 60 in a vicinity of the floor plate 5C as shown in FIG. 11A and FIG. 11B.

At the three-phase high frequency transformer 118, the structures of the three-legged ferrite core 5, the primary coils 11, 12, 13, and the secondary coils 21, 22, 23, and the connection of the lead lines 11A, 11B, 12A, 12B, 13A, 13B of the primary coils 11, 12, 13 are the same as the three-phase high frequency transformer 112 of embodiment 8.

The connecting member 60 has a triangular planar shape whose respective vertices are rounded, and is formed by bending a strip that is a conductor into this shape. The connecting member 60 is positioned at the outer side of the bottom plate 5C.

Further, the three-phase high frequency transformer 118 does not have the leg portions 9, and instead, the bottom plate 5C is directly placed on a substrate, and the fixing bolts 8 are screwed-together with screw holes provided in the substrate. Accordingly, the nuts 10 for fastening the upper half portion and the lower half portion of the three-legged ferrite core 5 are not needed.

In addition to the feature that the overall structure itself also can be simplified because the nuts 10 that screw-together with the fixing bolts 8 can be omitted, the three-phase high frequency transformer 118 also has the feature that, because the connecting member 60 can be formed by bending a strip that is a conductor, manufacturing is easier as compared with the connecting member 50 that requires punching by a press or the like.

12. Embodiment 12

Of the three-phase high frequency transformers of the present invention, a fifth example in which the primary coils are Δ-connected and the secondary coils are Y-connected is described hereinafter.

Figure 12A:
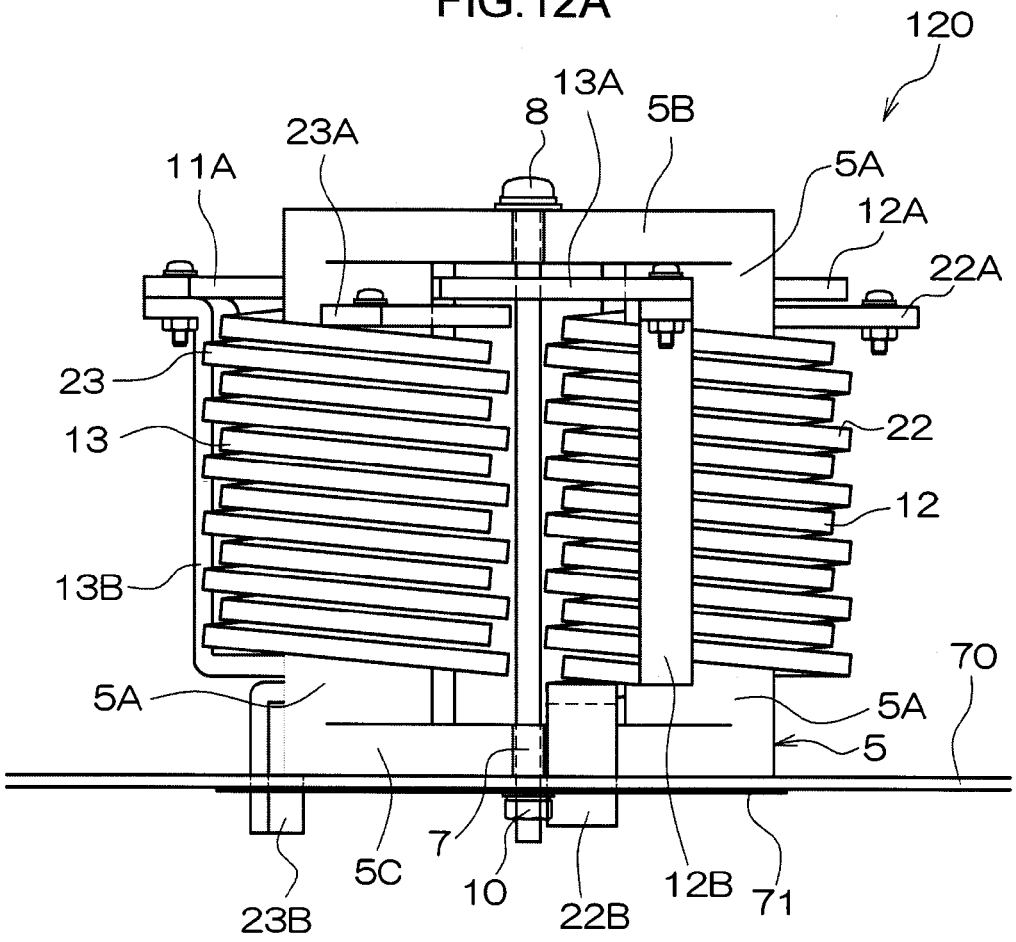
FIG. 12A is a side view showing the structure of a three-phase high frequency transformer relating to embodiment 12.
Figure 12B:
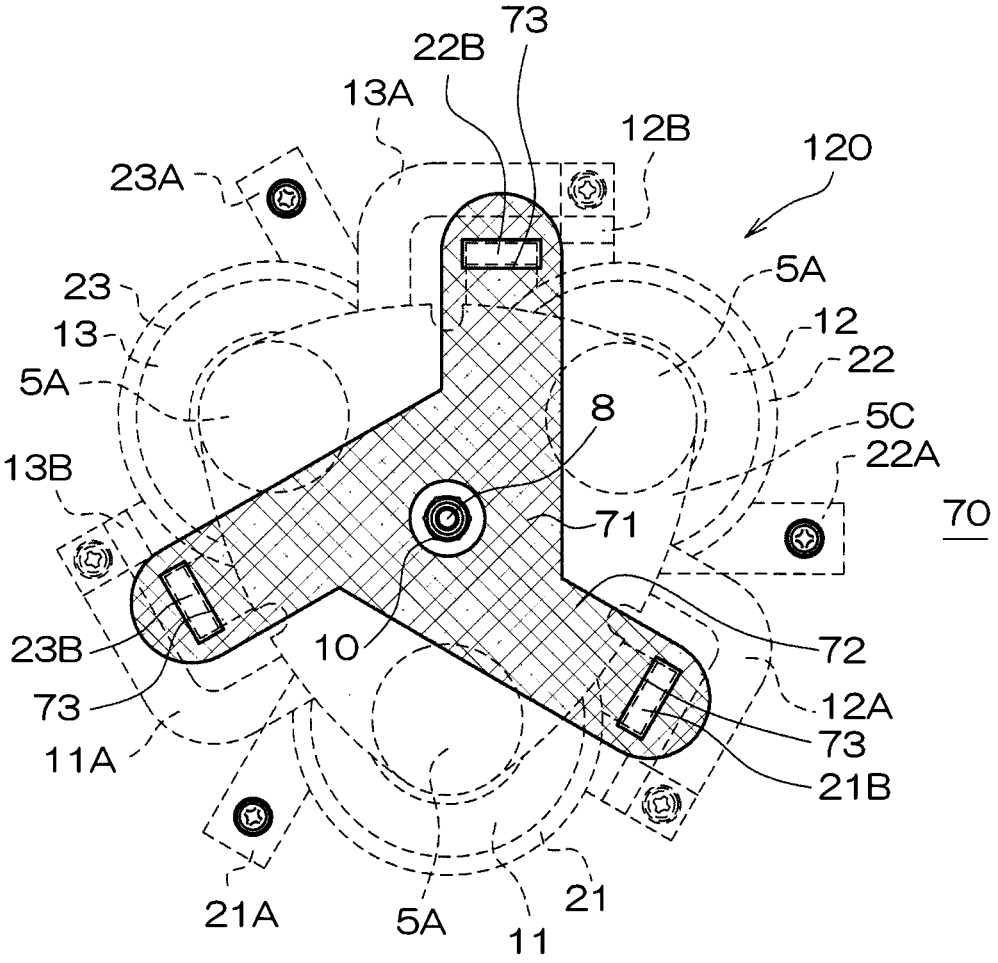
FIG. 12B is a bottom view when viewing the three-phase high frequency transformer relating to embodiment 12 from the reverse side of a printed substrate.

In a three-phase high frequency transformer 120 relating to embodiment 12, as shown in FIG. 12A and FIG. 12B, the final ends of the lead lines 21B, 22B, 23B of the secondary coils 21, 22, 23 are bent downward, and are inserted in the opening portions 73 that are provided in the printed circuit board 70. Here, the connected pattern 71 is formed at the portions where the opening portions 73 are formed at the reverse of the printed circuit board 70, so as to connect the three opening portions 73. Further, the lead lines 21B, 22B, 23B are soldered to the connected pattern 71 at the opening portions 73. Due thereto, the lead lines 21B, 22B, 23B are connected at the connected pattern 71.

Further, the fixing bolt 8 is inserted-through a hole provided in the printed circuit board 70, and the nut 10 is screwed-together from the reverse side of the printed circuit board 70.

At the three-phase high frequency transformer 120, the structures of the three-legged ferrite core 5, the primary coils 11, 12, 13 and the secondary coils 21, 22, 23, and the connection of the lead lines 11A, 11B, 12A, 12B, 13A, 13B of the primary coils 11, 12, 13 are the same as the three-phase high frequency transformer 112 of embodiment 8.

In addition to the features that the three-phase high frequency transformer 112 of embodiment 8 has, the three-phase high frequency transformer 120 has the feature that mounting on the printed circuit board 70 can be done easily.

13. Embodiment 13

Of the three-phase high frequency transformers of the present invention, a sixth example in which the primary coils are Δ-connected and the secondary coils are Y-connected is described hereinafter.

Figure 13A:
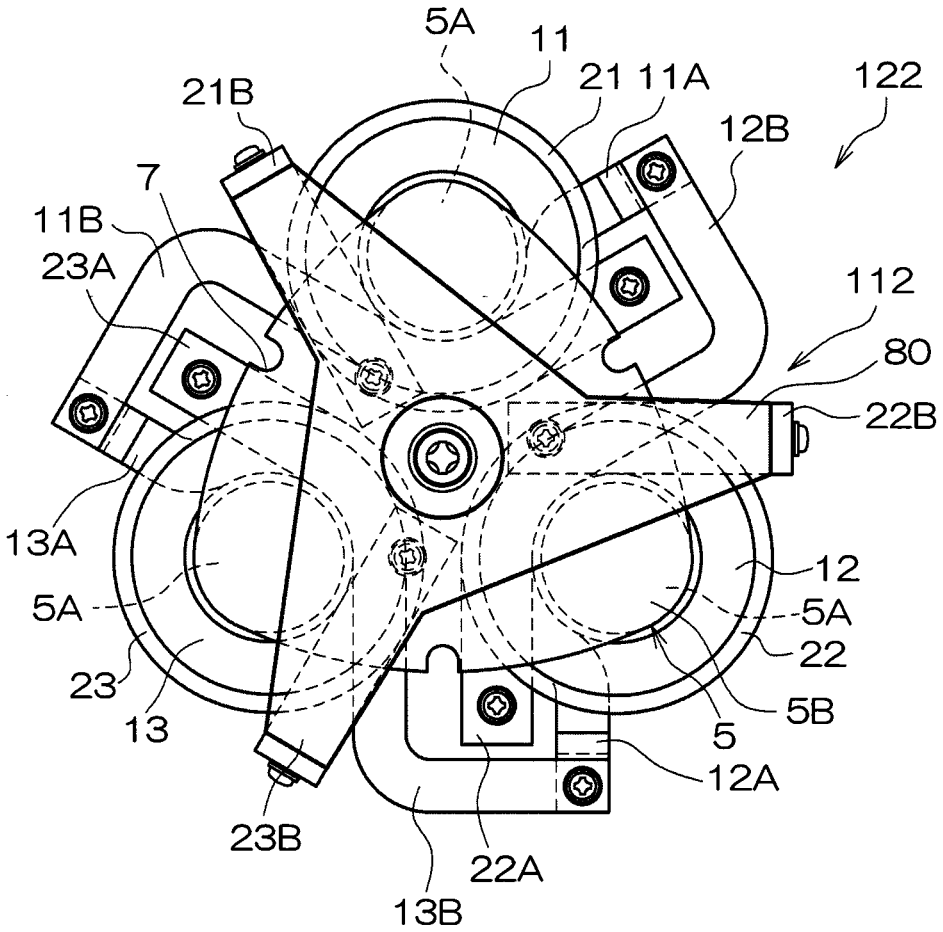
FIG. 13A is a plan view showing the structure of a three-phase high frequency transformer relating to embodiment 13.
Figure 13B:
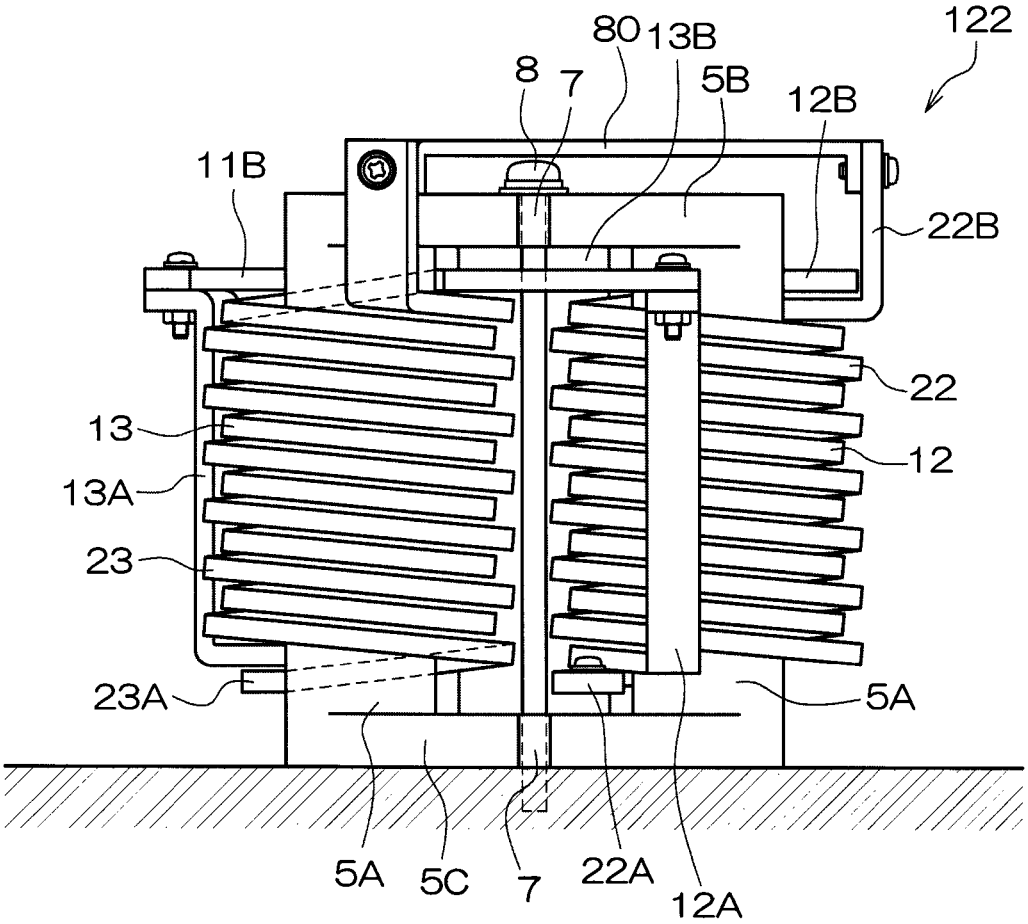
FIG. 13B is a side view showing the structure of the three-phase high frequency transformer relating to embodiment 13.

In a three-phase high frequency transformer 122 relating to embodiment 13, as shown in FIG. 13A and FIG. 13B, the final ends of the lead lines 21B, 22B, 23B of the secondary coils 21, 22, 23 are bent upward, and are respectively connected at the connecting member 80 that is substantially triangular. The connecting member 80 is a triangular shape whose ridge portions project-out to the outer side. The distal ends of the ridge portions are bent downward and are connected to the lead lines 21B, 22B, 23B.

Other than the above-described points, the three-phase high frequency transformer 122 has the same structure as the three-phase high frequency transformer 112 of embodiment 8.

14. Embodiment 14

Of the three-phase high frequency transformers of the present invention, an example in which the primary coils are Y-connected and the secondary coils are Δ-connected is described hereinafter.

Figure 14A:
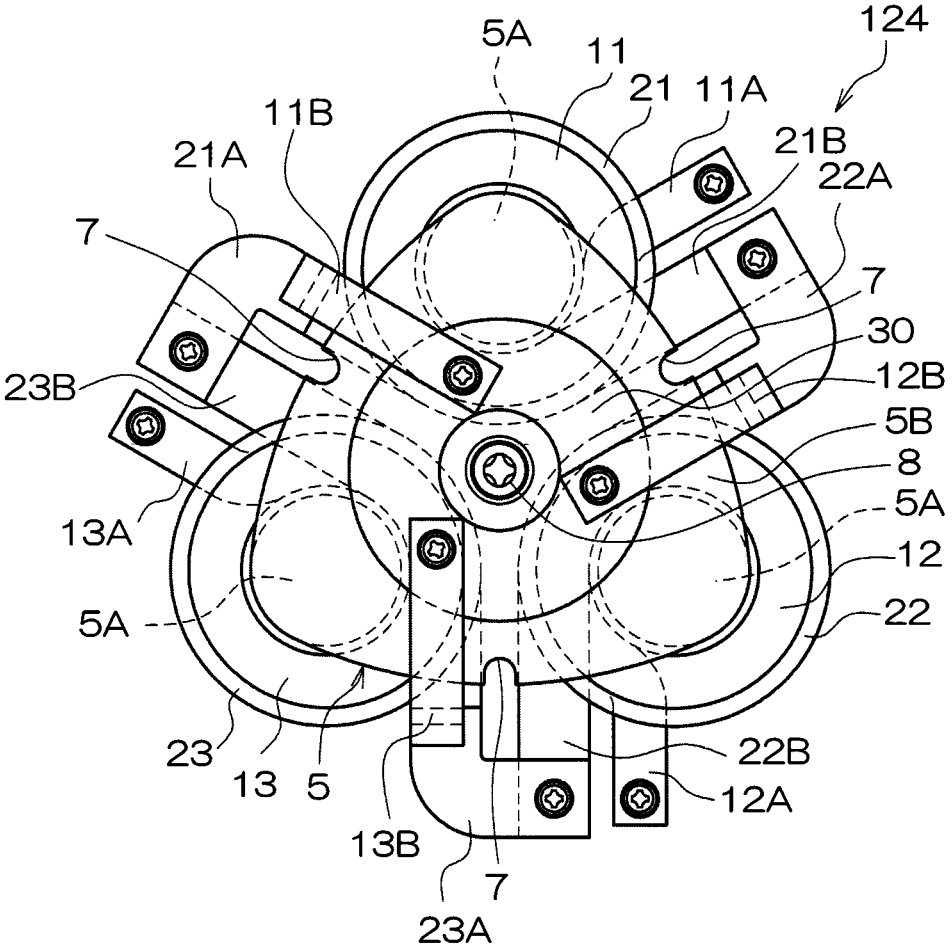
FIG. 14A is a plan view showing the structure of a three-phase high frequency transformer relating to embodiment 14.
Figure 14B:
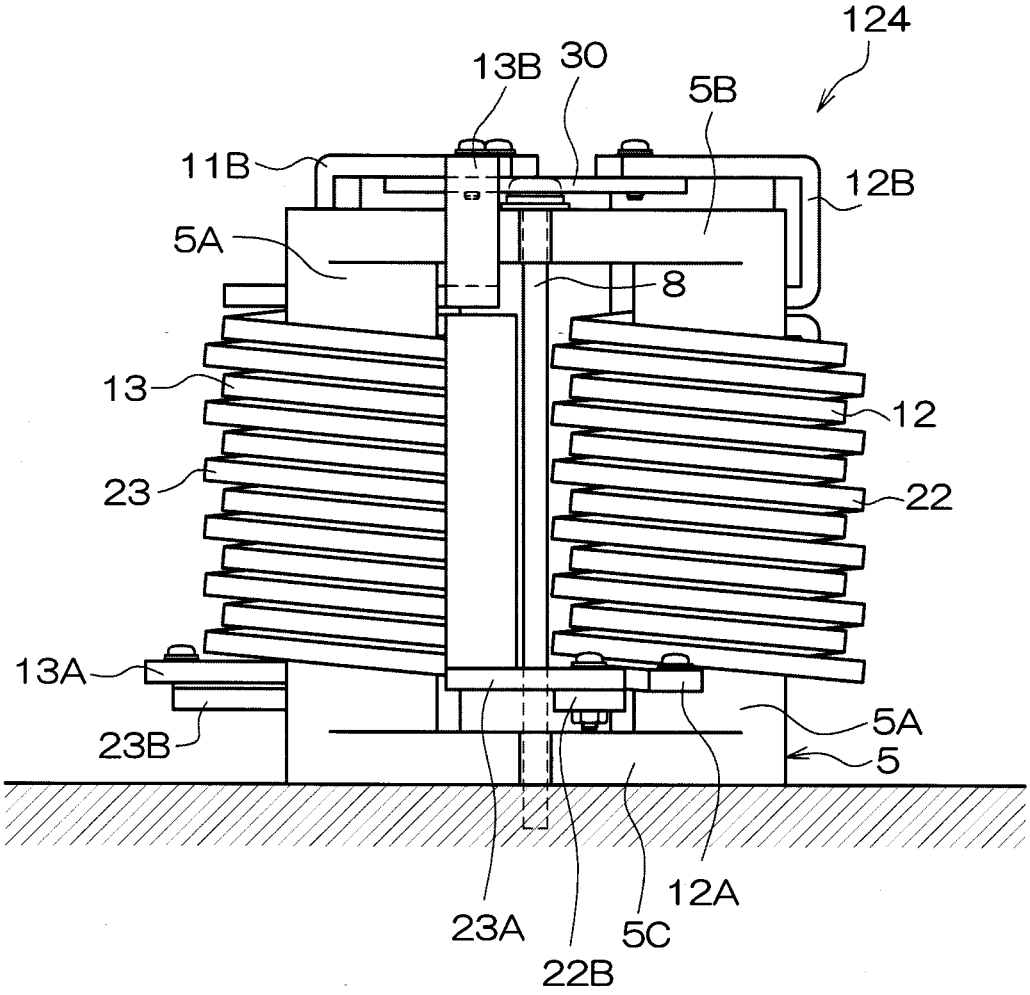
FIG. 14B is a side view showing the structure of the three-phase high frequency transformer relating to embodiment 14.

In a three-phase high frequency transformer 124 relating to embodiment 14, as shown in FIG. 14A and FIG. 14B, the primary coils 11, 12, 13 are all formed by winding flat wires upward from bottom to top, and the winding start portions are made to be the lead lines 11A, 12A, 13A respectively, and the winding end portions are made to be the lead lines 11B, 12B, 13B respectively.

Further, the lead lines 11B, 12B, 13B of the winding end sides are respectively bent upward, and further, at the final end portions, are bent horizontally so as to be directed toward the inner side, and are connected to the connecting member 30. The connecting member 30 is as described in embodiment 1.

On the other hand, the lead lines 11A, 12A, 13A of the winding start sides are connected to the U-phase, the V-phase, the W-phase of the input side, respectively. Accordingly, the primary coils 11, 12, 13 are Y-connected.

On the other hand, the secondary coils 21, 22, 23 are formed by winding flat wires, whose width is wider than the primary coils 11, 12, 13, downward from top to bottom. The winding start portions are made to be the lead lines 21A, 22A, 23A respectively, and the winding end portions are made to be the lead lines 21B, 22B, 23B respectively.

The lead lines 21A, 22A, 23A of the winding start sides are respectively bent downward, and the final ends thereof are at substantially the same height as the lead lines 21B, 22B, 23B of the winding end sides. Further, the lead line 21B at the winding end side of the secondary coil 21 is connected to the lead line 23A at the winding start side of the secondary coil 23, the lead line 23B at the winding end side of the secondary coil 23 is connected to the lead line 22A at the winding start side of the secondary coil 22, and the lead line 22B at the winding end side of the secondary coil 22 is connected to the lead line 21A at the winding start side of the secondary coil 21. Further, the connected portion of the lead line 21B and the lead line 23A, the connected portion of the lead line 23B and the lead line 22A, and the connected portion of the lead line 22B and the lead line 21A are connected to the U-phase, the V-phase, the W-phase of the output side respectively. Accordingly, the secondary coils 21, 22, 23 are Δ-connected.

Other than the above-described points, the three-phase high frequency transformer 124 has the same structure as the three-phase high frequency transformer 100 of embodiment 1.

At the three-phase high frequency transformer 124 as well, the upper half portions of the columnar cores 5A and the ceiling plate 5B, and the lower half portions of the columnar cores 5A and the bottom plate 5C are formed integrally, and respectively structure the upper half portion and the lower half portion of the three-legged ferrite core 5. Further, because the upper half portion and the lower half portion of the three-legged ferrite core 5 are strongly fastened by the fixing bolts 8 that are inserted-through the bolt insert-through hole 6 and the bolt insert-through grooves 7, no air gaps are formed between the columnar cores 5A and the ceiling plate 5B and the bottom plate 5C, and between the upper half portions and the lower half portions of the columnar cores 5A, and therefore, an increase in iron loss due to the existence of air gaps can be effectively suppressed.

Further, because the inner diameters of the primary coils 11, 12, 13 and the secondary coils 21, 22, 23 are equal, and further, the inner peripheries are disposed so as to coincide, the gaps between the primary coils 11, 12, 13 and the secondary coils 21, 22, 23, and the columnar cores 5A, are narrow, and therefore, even when used at high frequencies, a high conversion efficiency can be achieved.

Moreover, because the primary coils 11, 12, 13 are Y-connected and the secondary coils 21, 22, 23 are Δ-connected, the three-phase high frequency transformer 124 is suitable as a transformer for large electric power. Further, there is also the advantage that, when high frequency waves are included in the input, the high frequency waves circulate through the secondary coils 21, 22, 23 that are Δ-connected, and the high frequency waves do not mix with the output waves.

15. Embodiment 15

Of the three-phase high frequency transformers of the present invention, a second example in which the primary coils are Y-connected and the secondary coils are Δ-connected is described hereinafter.

Figure 15A:
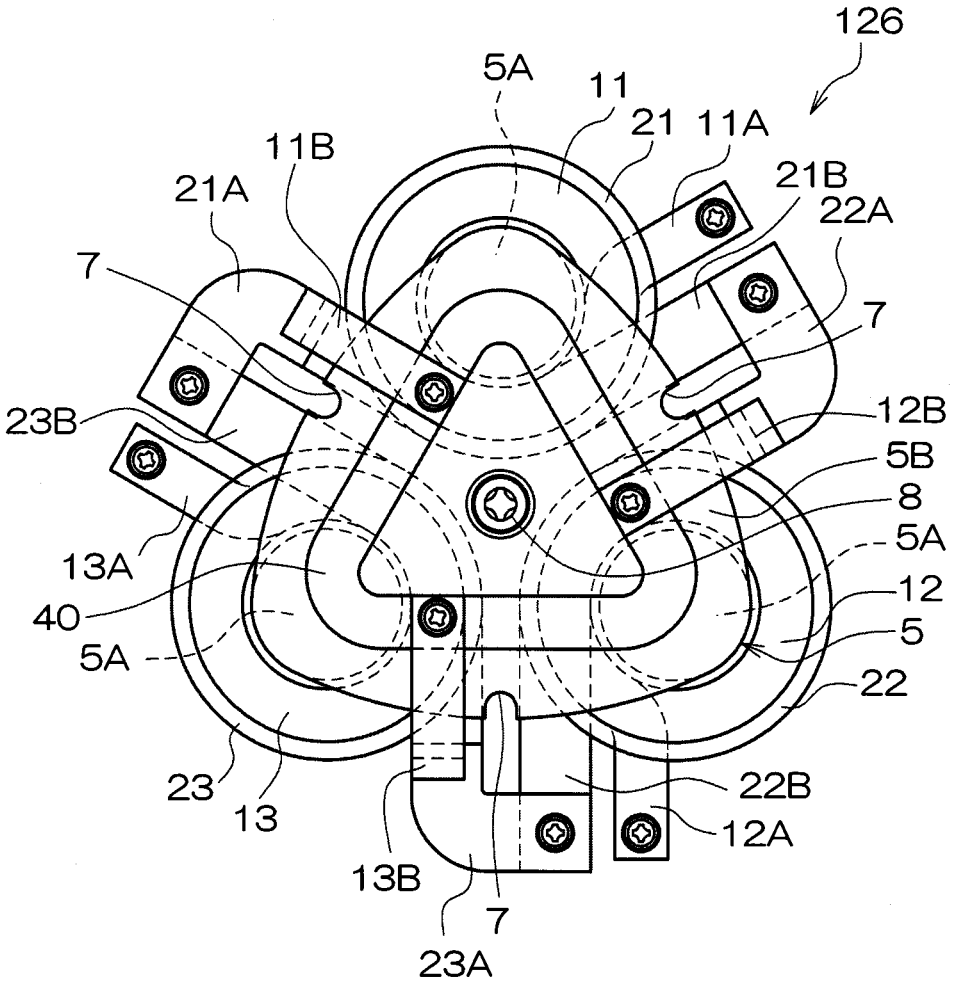
FIG. 15A is a plan view showing the structure of a three-phase high frequency transformer relating to embodiment 15.
Figure 15B:
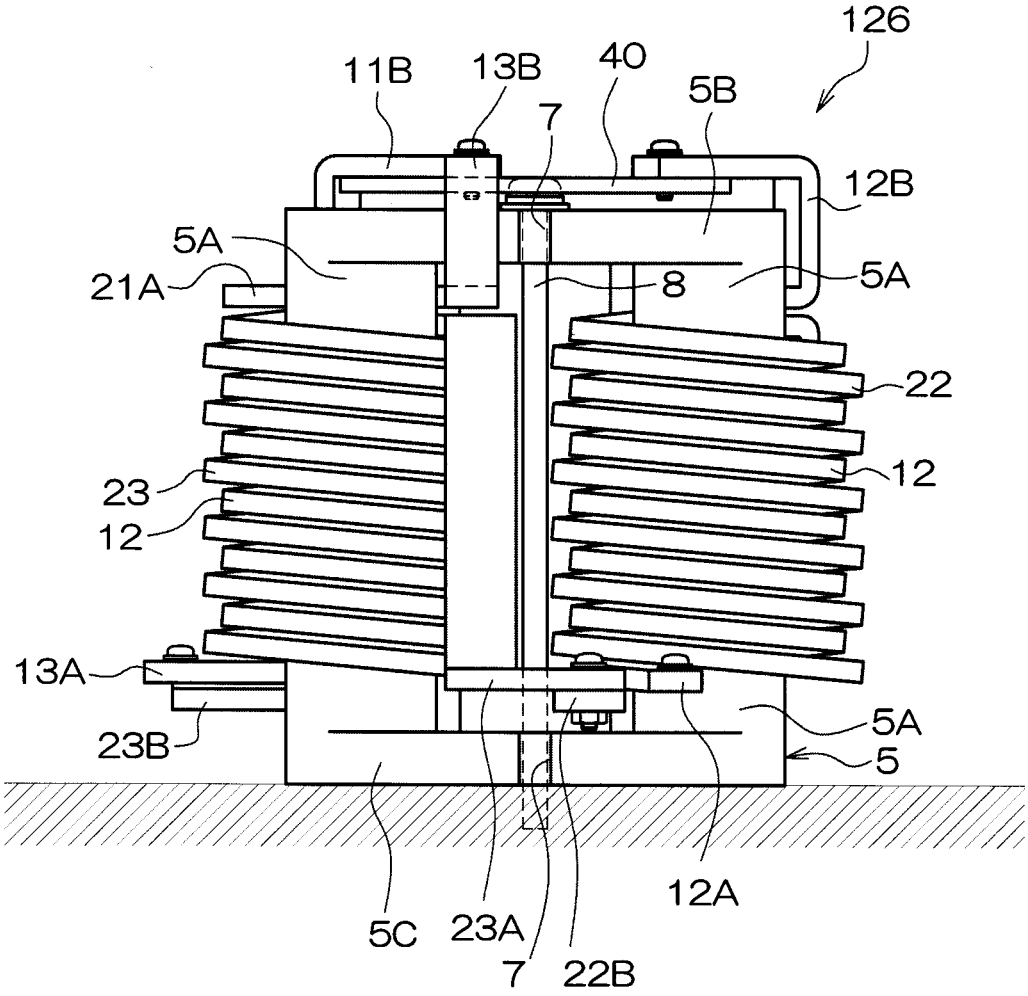
FIG. 15B is a side view showing the structure of the three-phase high frequency transformer relating to embodiment 15.

As shown in FIG. 15A and FIG. 15B, a three-phase high frequency transformer 126 relating to embodiment 15 has a similar structure as the three-phase high frequency transformer 124 of embodiment 14 except that the connecting member 40, that is formed from a plate-shaped conductor and has a triangular outer periphery whose respective vertices are rounded and in whose central portion is provided an opening portion of a similar shape as the outer periphery, is used as the connecting member that connects the lead lines 11B, 12B, 13B of the primary coils 11, 12, 13, instead of the connecting member 30 in embodiment 14. Further, the operation as well is similar.

16. Embodiment 16

Of the three-phase high frequency transformers of the present invention, a third example in which the primary coils are Y-connected and the secondary coils are Δ-connected is described hereinafter.

Figure 16A:
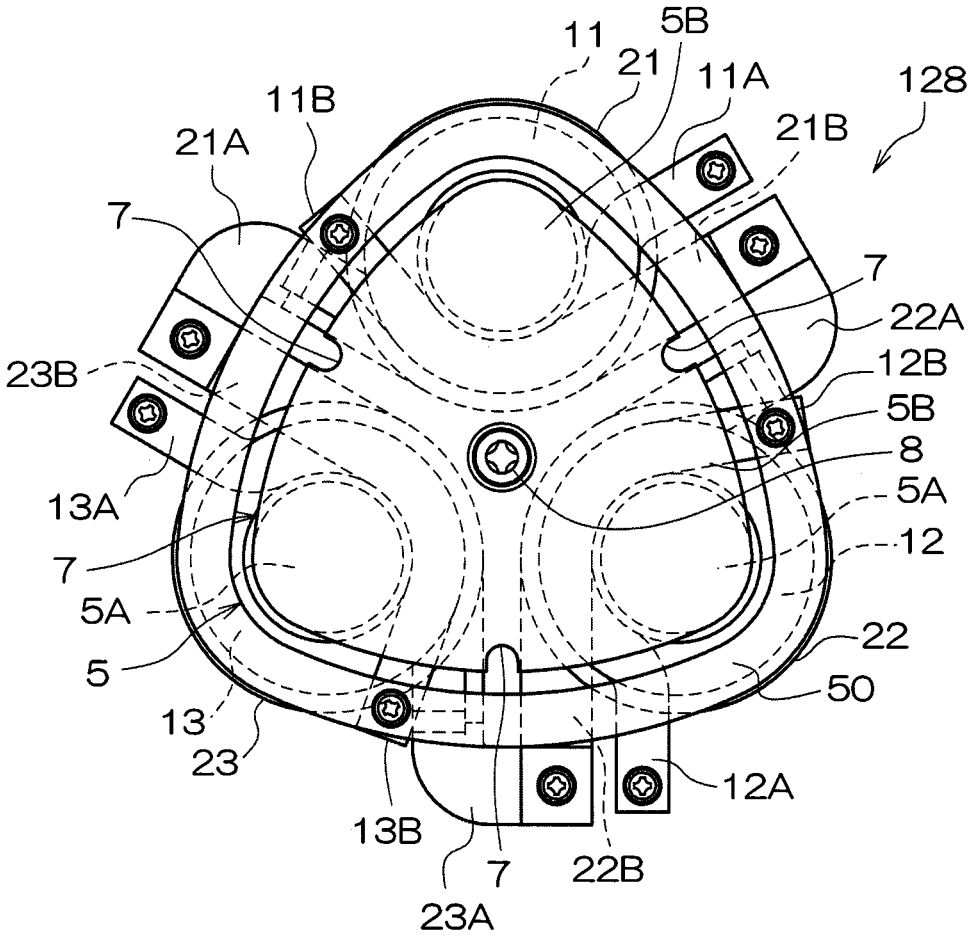
FIG. 16A is a plan view showing the structure of a three-phase high frequency transformer relating to embodiment 16.
Figure 16B:
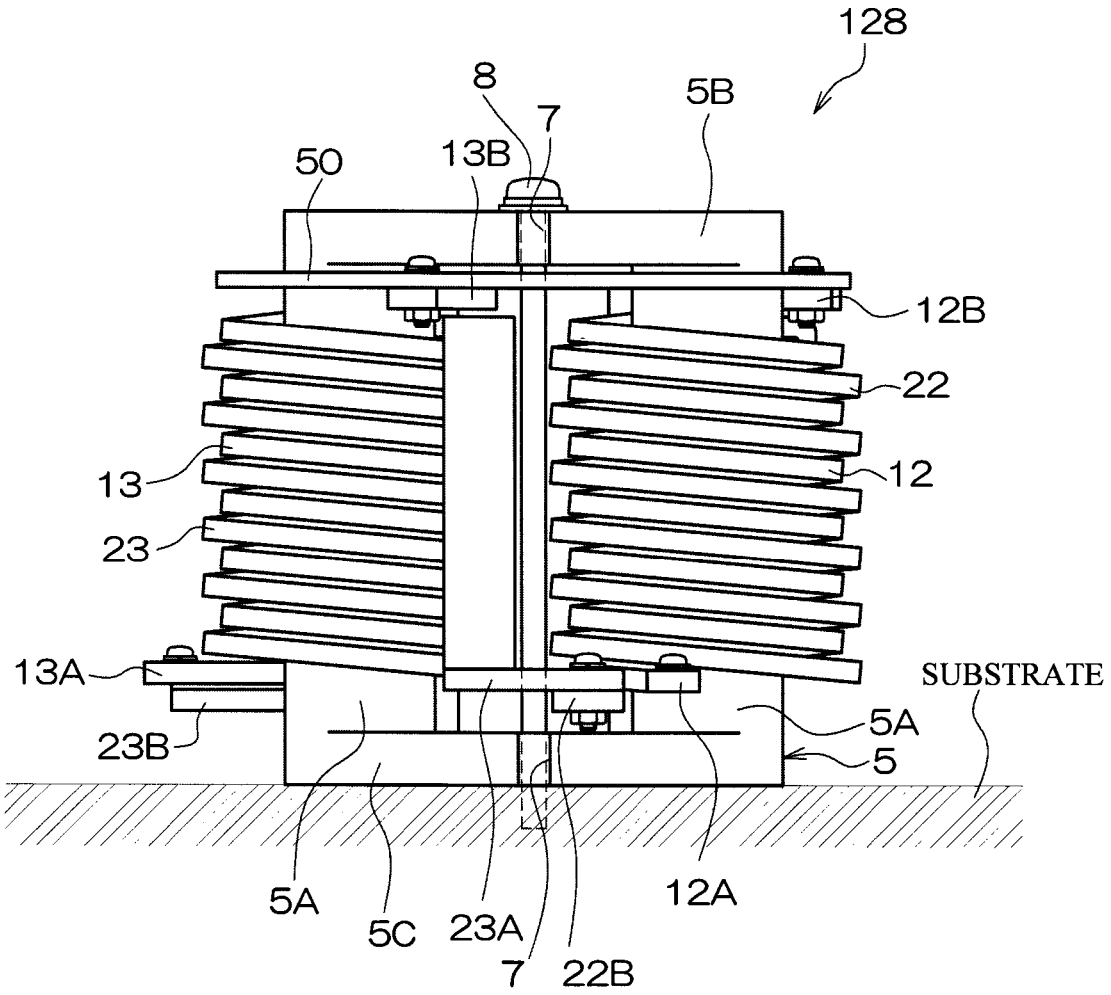
FIG. 16B is a side view showing the structure of the three-phase high frequency transformer relating to embodiment 16.

In a three-phase high frequency transformer 128 relating to embodiment 16, differently from the three-phase high frequency transformer 124 of embodiment 14 and the three-phase high frequency transformer 126 of embodiment 15, the final ends of the lead lines 11B, 12B, 13B of the primary coils 11, 12, 13 are not bent in the vertical direction and are, while still in an winding end state, connected by the connecting member 50 in a vicinity of the ceiling plate 5B as shown in FIG. 16A and FIG. 16B.

The connecting member 50 all is formed from a plate-shaped conductor, and has a triangular outer periphery whose respective vertices are rounded, and an opening portion of a similar configuration as the outer periphery is provided in the central portion thereof. However, the connecting member 50 is positioned at the outer side of the ceiling plate 5B.

Further, the three-phase high frequency transformer 128 does not have the leg portions 9, and instead, the bottom plate 5C is directly placed on a substrate, and the fixing bolts 8 are screwed-together with screw holes provided in the substrate. Accordingly, the nuts 10 for fastening the upper half portion and the lower half portion of the three-legged ferrite core 5 are not needed.

At the three-phase high frequency transformer 128, the structures of the three-legged ferrite core 5, the primary coils 11, 12, 13, and the secondary coils 21, 22, 23, and the connection of the lead lines 21A, 21B, 22A, 22B, 23A, 23B of the secondary coils 21, 22, 23, are the same as the three-phase high frequency transformer 124 of embodiment 14.

In addition to the features that the three-phase high frequency transformer 124 of embodiment 14 and the three-phase high frequency transformer 126 of embodiment 15 have, the three-phase high frequency transformer 128 has the feature that the post-processing of the lead lines 11B, 12B, 13B of the primary coils 11, 12, 13 can be greatly simplified, and further, has the feature that the overall structure itself also can be simplified because the nuts 10 that screw-together with the fixing bolts 8 can be omitted.

17. Embodiment 17

Of the three-phase high frequency transformers of the present invention, a fourth example in which the primary coils are Y-connected and the secondary coils are Δ-connected is described hereinafter.

Figure 17A:
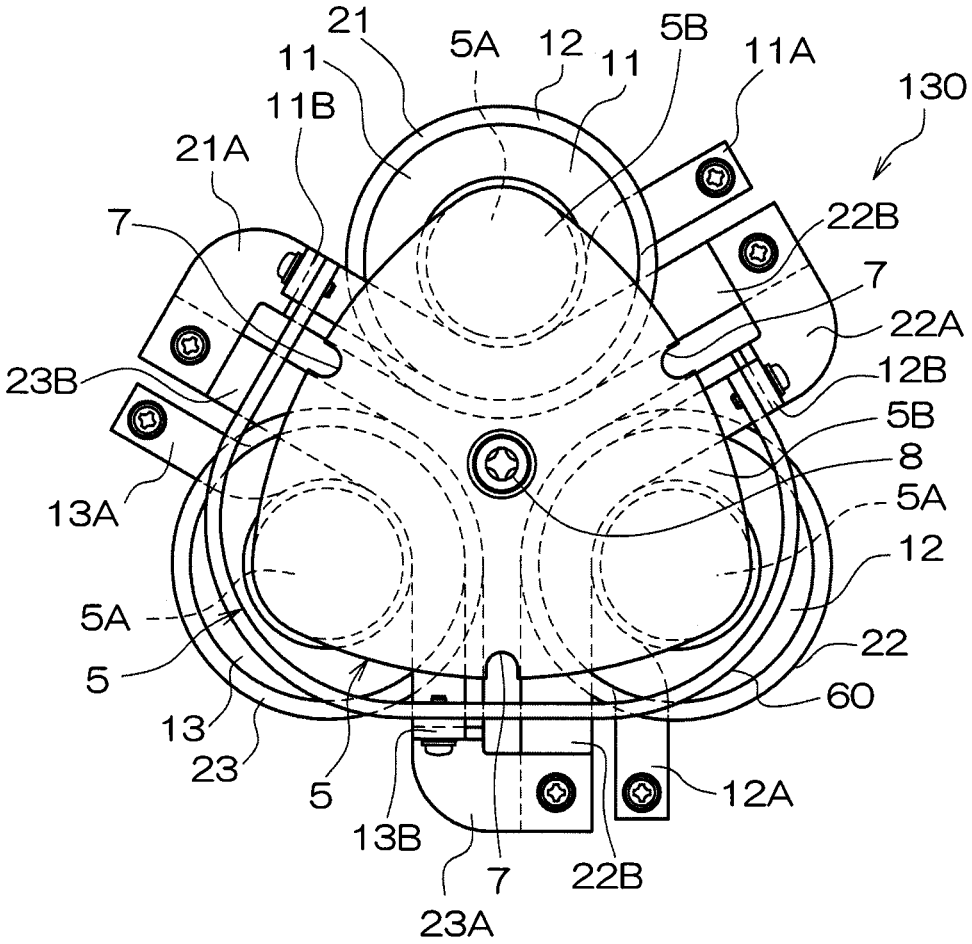
FIG. 17A is a plan view showing the structure of a three-phase high frequency transformer relating to embodiment 17.
Figure 17B:
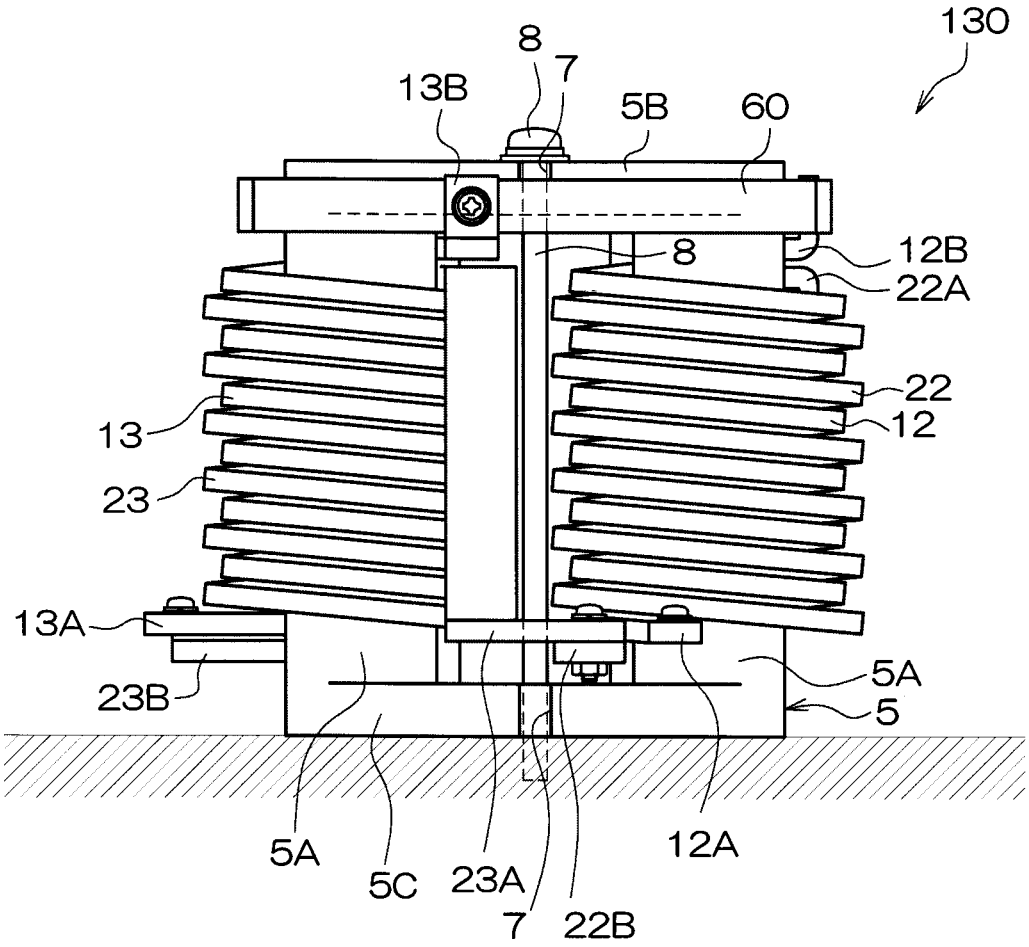
FIG. 17B is a side view showing the structure of the three-phase high frequency transformer relating to embodiment 17.

In a three-phase high frequency transformer 130 relating to embodiment 17, differently from the three-phase high frequency transformer 124 of embodiment 14 and the three-phase high frequency transformer 126 of embodiment 15, the final ends of the lead lines 11B, 12B, 13B of the primary coils 11, 12, 13 are bent upward and are connected by the connecting member 60 in a vicinity of the ceiling plate 5B as shown in FIG. 17A and FIG. 17B.

At the three-phase high frequency transformer 130, the structures of the three-legged ferrite core 5, the primary coils 11, 12, 13, and the secondary coils 21, 22, 23, and the connection of the lead lines 21A, 21B, 22A, 22B, 23A, 23B of the secondary coils 21, 22, 23 are the same as the three-phase high frequency transformer 124 of embodiment 14.

The connecting member 60 has a triangular planar shape whose respective vertices are rounded, and is formed by bending a strip that is a conductor into this shape. The connecting member 60 is positioned at the outer side of the bottom plate 5C.

Further, the three-phase high frequency transformer 130 does not have the leg portions 9, and instead, the bottom plate 5C is directly placed on a substrate, and the fixing bolts 8 are screwed-together with screw holes provided in the substrate. Accordingly, the nuts 10 for fastening the upper half portion and the lower half portion of the three-legged ferrite core 5 are not needed.

In addition to the feature that the overall structure itself also can be simplified because the nuts 10 that screw-together with the fixing bolts 8 can be omitted, the three-phase high frequency transformer 130 also has the feature that, because the connecting member 60 can be formed by bending a strip that is a conductor, manufacturing is easy as compared with the connecting member 50 that requires punching by a press or the like.

18. Embodiment 18

Of the three-phase high frequency transformers of the present invention, a fifth example in which the primary coils are Y-connected and the secondary coils are Δ-connected is described hereinafter.

Figure 18A:
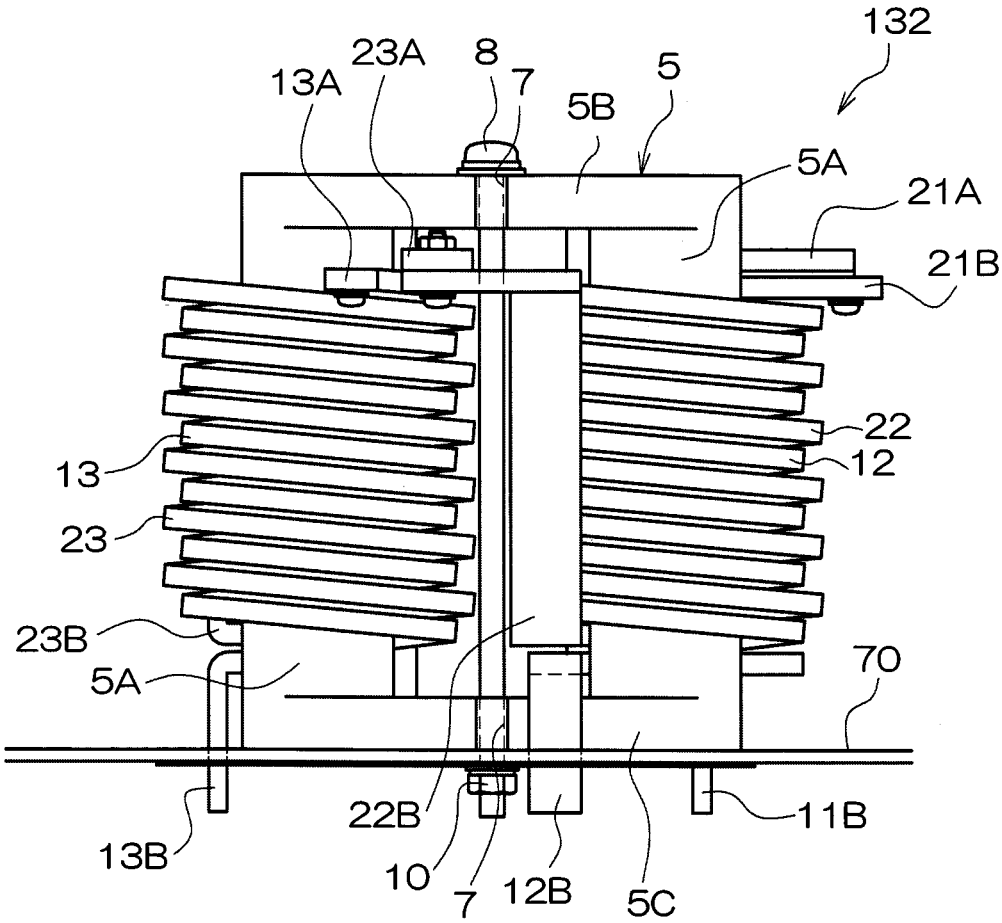
FIG. 18A is a side view showing the structure of a three-phase high frequency transformer relating to embodiment 18.
Figure 18B:
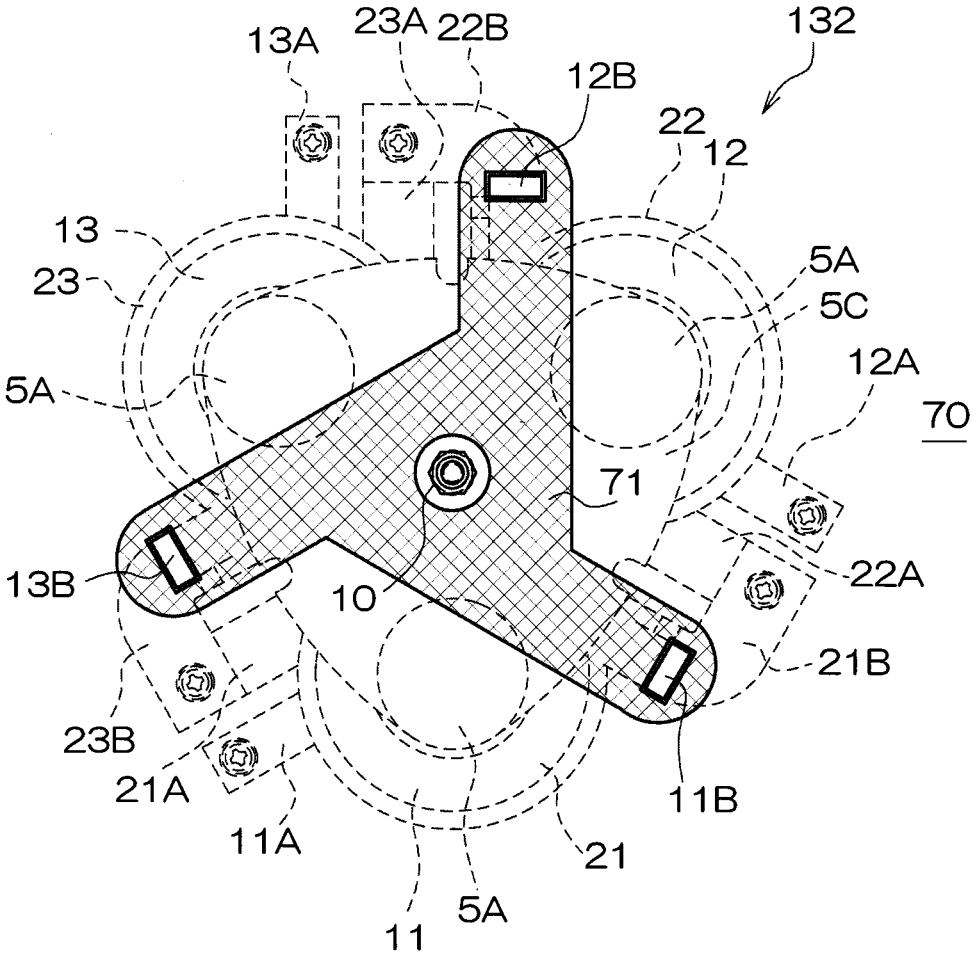
FIG. 18B is a bottom view when viewing the three-phase high frequency transformer relating to embodiment 18 from the reverse side of a printed substrate.

In a three-phase high frequency transformer 132 relating to embodiment 18, as shown in FIG. 18A and FIG. 18B, the final ends of the lead lines 11B, 12B, 13B of the primary coils 11, 12, 13 are bent downward, and are inserted in the opening portions 73 that are provided in the printed circuit board 70. Here, the connected pattern 71 is formed at the portions where the opening portions 73 are formed at the reverse of the printed circuit board 70, so as to connect the three opening portions 73. Further, the lead lines 11B, 12B, 13B are soldered to the connected pattern 71 at the opening portions 73. Due thereto, the lead lines 11B, 12B, 13B are connected at the connected pattern 71.

Further, the fixing bolt 8 is inserted-through a hole provided in the printed circuit board 70, and the nut 10 is screwed-together from the reverse side of the printed circuit board 70.

At the three-phase high frequency transformer 132, the structures of the three-legged ferrite core 5, the primary coils 11, 12, 13 and the secondary coils 21, 22, 23, and the connection of the lead lines 21A, 21B, 22A, 22B, 23A, 13B of the secondary coils 21, 22, 23, are the same as the three-phase high frequency transformer 124 of embodiment 14.

In addition to the features that the three-phase high frequency transformer 124 of embodiment 14 has, the three-phase high frequency transformer 132 has the feature that mounting to the printed circuit board 70 can be done easily.

19. Embodiment 19

Of the three-phase high frequency transformers of the present invention, a sixth example in which the primary coils are Y-connected and the secondary coils are Δ-connected is described hereinafter.

Figure 19A:
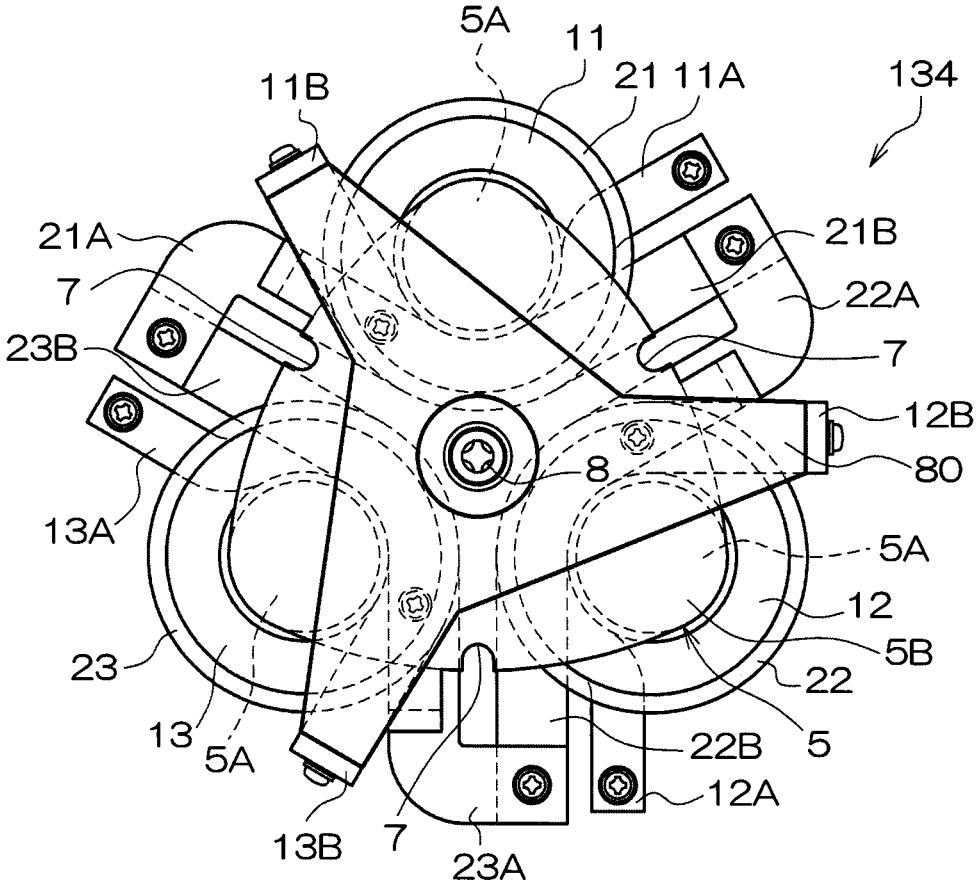
FIG. 19A is a plan view showing the structure of a three-phase high frequency transformer relating to embodiment 19.
Figure 19B:
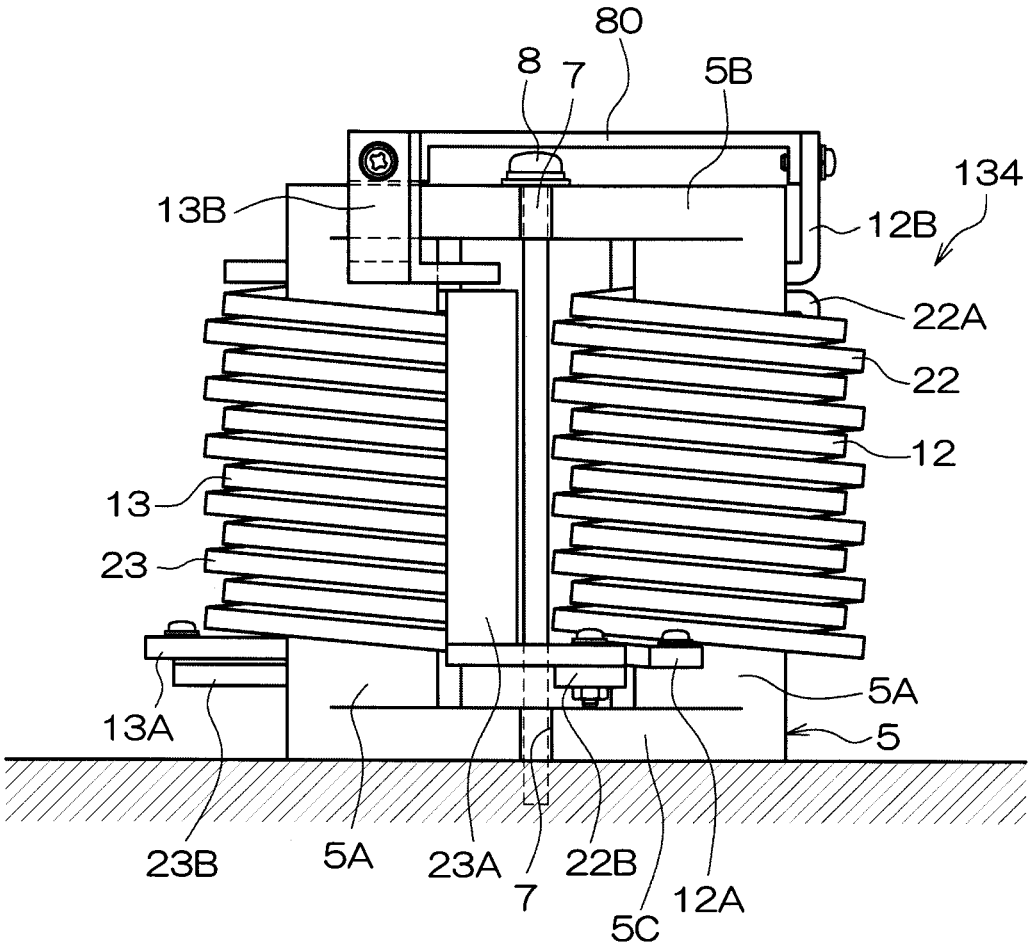
FIG. 19B is a side view showing the structure of the three-phase high frequency transformer relating to embodiment 19.

In a three-phase high frequency transformer 134 relating to embodiment 19, as shown in FIG. 19A and FIG. 19B, the final ends of the lead lines 11B, 12B, 13B of the primary coils 11, 12, 13 are bent upward, and are respectively connected at the connecting member 80 that is substantially triangular. The connecting member 80 is a triangular shape whose ridge portions project-out to the outer side. The distal ends of the ridge portions are bent downward and are connected to the lead lines 11B, 12B, 13B.

Other than the above-described points, the three-phase high frequency transformer 134 has the same structure as the three-phase high frequency transformer 124 of embodiment 14.

The invention claimed is:

1. A three-phase high frequency transformer comprising:

three solid-cylindrical cores that are formed of ferrite and that are disposed at uniform intervals on a circumference;

a ceiling plate formed of ferrite and connected to first ends of the solid-cylindrical cores; a bottom plate formed of ferrite and connected to second ends of the solid-cylindrical cores; and three sets of coils having primary coils of a predetermined inner diameter formed by flat wires wound edgewise, and secondary coils that have an inner diameter that is the same as the inner diameter of the primary coils and are formed of flat wires wound edgewise, the flat wires forming the secondary coils having at least one of a width or a thickness different than those of the flat wires forming the primary coils, each of the flat wires of the primary coils and the secondary coils having a larger measurement in a width direction than in a thickness direction, wherein the primary coils and the secondary coils are configured such that high frequency current flows therein, wherein both the primary coils and the secondary coils are helical coils, wherein the flat wires structuring the secondary coils are inserted within intervals of the flat wires structuring the primary coils, or the flat wires structuring the primary coils are inserted within intervals of the flat wires structuring the secondary coils, and the three sets of coils are structured such that inner peripheries of the primary coils and inner peripheries of the secondary coils coincide, and are disposed such that the respective solid-cylindrical cores are inserted in respective inner portions of the three sets of coils, wherein the primary coils and the secondary coils are Δ-connected, wherein each of the three primary coils of the three sets of coils is Δ-connected by connecting one end of one primary coil to the other end of another primary coil by a first connecting line, wherein each of the three secondary coils of the three sets of coils is Δ-connected by connecting one end of one secondary coil to the other end of another secondary coil by a fourth connecting line, wherein the first connecting line is a conductor associated with each of the three primary coils and arranged outside each of the three sets of coils and extending along the solid-cylindrical cores, wherein the fourth connecting line is a conductor associated with each of the three secondary coils and arranged outside each of the three sets of coils and extending along the solid-cylindrical cores, wherein at least the first connecting line is a plate-shaped conductor that comprises a vertical section and a horizontal section; the first connecting line is disposed at the side of one of the top plate core and the bottom plate core along one of the upper and lower surface of one of the top plate and bottom plate core, wherein at least one winding end portion of one of the primary coils is connected by a bolt to the upper end of the first connecting line in the vertical direction and another primary coil has a winding end portion that is connected to the lower end of first connection line that is bent in the horizontal direction, wherein at least the fourth connecting line is a plate-shaped conductor that comprises a vertical section and a horizontal section, the fourth connecting line is disposed at side of one of the top plate core and the bottom plate core along one of the upper and lower surface of one of the top plate and bottom plate core, and wherein at least one winding end portion of one of the secondary coils is connected by a bolt to the upper end of the fourth connecting line in the vertical direction and another secondary coil has a winding end portion that is connected to the lower end of fourth connection line that is bent in the horizontal direction.

2. The three-phase high frequency transformer of claim 1 wherein a bolt-insert through groove is formed at the central portion of each side of the ceiling plate and at the central portion of each side of the bottom plate, and wherein a fixing bolt for fastening the ceiling plate, the solid-cylindrical cores, and the bottom plate is inserted through the bolt insert-through groove.

* * * * *